US008102339B2

(12) United States Patent
Yoshida

(10) Patent No.: US 8,102,339 B2
(45) Date of Patent: Jan. 24, 2012

(54) LIQUID CRYSTAL DISPLAY DEVICE, DRIVING CIRCUIT FOR THE SAME AND DRIVING METHOD FOR THE SAME

(75) Inventor: Hiroshi Yoshida, Mie (JP)

(73) Assignee: Sharp Kabushiki Kaisha, Osaka (JP)

( * ) Notice: Subject to any disclaimer, the term of this patent is extended or adjusted under 35 U.S.C. 154(b) by 1111 days.

(21) Appl. No.: 11/886,333

(22) PCT Filed: Mar. 7, 2006

(86) PCT No.: PCT/JP2006/304367

§ 371 (c)(1),
(2), (4) Date: Sep. 14, 2007

(87) PCT Pub. No.: WO2006/109376

PCT Pub. Date: Oct. 19, 2006

(65) Prior Publication Data

US 2008/0180416 A1 Jul. 31, 2008

(30) Foreign Application Priority Data

Apr. 5, 2005 (JP) ..... 2005-108741

(51) Int. Cl.
*G09G 3/36* (2006.01)

(52) U.S. Cl. ..... 345/87; 345/89; 345/96

(58) Field of Classification Search ..... 345/87–92, 345/96, 204

See application file for complete search history.

(56) References Cited

U.S. PATENT DOCUMENTS 5,473,168 A * 12/1995 Kawai et al. ..... 257/61
5,654,733 A 8/1997 Chimura et al.
6,115,084 A * 9/2000 Miyashita et al. ..... 348/792
6,307,681 B1 * 10/2001 Aoki et al. ..... 359/645
6,377,235 B1 * 4/2002 Murade et al. ..... 345/100
2002/0000969 A1 * 1/2002 Ozawa ..... 345/100
2002/0093494 A1 * 7/2002 Hanari ..... 345/204
2002/0097211 A1 * 7/2002 Yasunishi et al. ..... 345/89
2003/0214476 A1 * 11/2003 Matsuda et al. ..... 345/100
2006/0012555 A1 * 1/2006 Tokumura ..... 345/98

FOREIGN PATENT DOCUMENTS

JP 01-128098 5/1989
JP 02-204718 8/1990
JP 05-122640 A 5/1993
JP 05-346571 A 12/1993
JP 06-141269 5/1994
JP 08-30242 A 2/1996
JP 2002-123230 4/2002

* cited by examiner

*Primary Examiner* — Amare Mengistu

*Assistant Examiner* — Koosha Sharifi-Tafreshi

(74) *Attorney, Agent, or Firm* — Harness, Dickey & Pierce, P.L.C.

(57) ABSTRACT

An embodiment of the present invention aims to allow a display device employing the dot-sequential drive system and the line common inversion system to suppress reduction of visual quality when pixel defects are corrected by source-drain short-circuiting or any TFTs with poor properties are present. A display control circuit outputs a video signal, such that the video signal is inputted to a source driver with the input order of the video signal being alternately switched every horizontal scanning period between the order from the first to the n'th source bus line and the n'th to the first source bus line. In accordance with this, the source driver reverses the order of applying the video signal to the source bus lines every horizontal scanning period.

11 Claims, 18 Drawing Sheets

LIQUID CRYSTAL DISPLAY DEVICE, DRIVING CIRCUIT FOR THE SAME AND DRIVING METHOD FOR THE SAME

TECHNICAL FIELD

The present invention relates to display devices, and particularly to a liquid crystal display device with the dot-sequential drive system, as well as a circuit and a method for driving such a display device.

BACKGROUND ART

In general, active matrix liquid crystal display devices include a display section with two transparent substrates having a liquid crystal layer provided therebetween, one of which has a plurality of source bus lines as video signal lines and a plurality of gate bus lines as scanning signal lines, the source bus lines and the gate bus lines being arranged in a grid form, pixel formation portions being arranged in a matrix form at their corresponding intersections between the source bus lines and the gate bus lines. The active matrix liquid crystal display devices also include a source driver for driving the source bus lines in the display section and a gate driver for driving the gate bus lines in the display section.

FIG. 1 is a block diagram illustrating the configuration of a substantial part of a active matrix liquid crystal display device, along with an equivalent circuit in the display section. The liquid crystal display device includes a display control circuit 200, a source driver 300, a gate driver 400, and a display section 600. The display section 600 has provided therein a plurality (n) of source bus lines SL1 to SLn and a plurality (m) of gate bus lines GL1 to GLm, which (perpendicularly) cross each other. The source bus lines SL1 to SLn are connected to the source driver 300, while the gate bus lines GL1 to GLm are connected to the gate driver 400. In addition, a thin film transistor 60 (hereinafter, referred to as a "TFT 60") acting as a switching element and a pixel capacitance 61 connected to the TFT 60 are provided at each intersection between the source bus lines SL1 to SLn and the gate bus lines GL1 to GLm. Each TFT 60 has a gate terminal connected to any one of the gate bus lines GL1 to GLm, a source terminal connected to any one of the source bus lines SL1 to SLn, and a drain terminal connected to the pixel capacitance 61. The pixel capacitance 61 is composed of a liquid crystal capacitance and an auxiliary capacitance (retention capacitance), the liquid crystal capacitance being a display medium provided between a pixel electrode, which is a transparent electrode, and a common electrode (counter electrode) provided opposite thereto, the auxiliary capacitance being provided in parallel with the liquid crystal capacitance.

For such a liquid crystal display device, there is a conventionally-known drive method called the "dot-sequential drive system" in which the source bus lines SL1 to SLn are sequentially driven one by one. According to this drive method, the source driver 300 sequentially applies a video signal to each of the source bus lines SL1 to SLn for a predetermined period of time. On the other hand, the gate driver 400 sequentially selects each of the gate bus lines GL1 to GLm for one horizontal scanning period in accordance with a horizontal synchronization signal HSY and a vertical synchronization signal VSY, which are outputted from the display control circuit 200, to bring the TFTs 60 connected to the selected gate bus line into a conductive state. As a result, the video signals applied to the source bus lines SL1 to SLn are sequentially written to the pixel capacitances 61 connected to the TFTs 60 that have been turned on. When the TFTs 60 on the selected gate bus line are rendered non-conductive, the charge of the pixel capacitances 61 connected to the TFTs 60 is retained until the video signal AV is written in the next frame period.

Incidentally, as for liquid crystal molecules included in the liquid crystal capacitances of the pixel capacitances 61 in the display section 600, when a direct-current voltage is applied thereto for a long period of time, polarization takes place, resulting in deterioration of properties. Accordingly, the voltage to be applied to the liquid crystal capacitances is generally inverted every frame period. Also, in order to enhance visual quality, a drive method called the "line inversion system" is employed, in which a voltage having its polarity changed every horizontal scanning line is applied to the liquid crystal layer. According to this drive method, the polarity of the video signal with reference to the potential of the common electrode (common electrode potential) is switched every horizontal scanning period. Note that such a change in polarity of the video signal with reference to the common electrode potential is referred to as "polarity inversion". Examples of the methods for realizing the polarity inversion include a method in which only the potential of the video signal is switched every horizontal scanning period, while maintaining the common electrode potential at a constant level, and a method in which both the common electrode potential and the potential of the video signal are switched every horizontal scanning period. According to the latter method (hereinafter, referred to as the "line common inversion system"), the common electrode potential is switched between high and low potential levels every horizontal scanning period. In addition, the potential of the video signal is set as negative with respect to the common electrode potential when the common electrode potential is at high potential level, and positive when the common electrode potential is at low potential level.

FIG. 13 is a signal waveform diagram for the video signal AV in the conventional liquid crystal display device. As shown in FIG. 13, one horizontal scanning period includes a horizontal effective display period in which the video signal AV is outputted to any one of the source bus lines SL1 to SLn, and a horizontal blanking period in which no video signal AV is outputted to any of the source bus lines SL1 to SLn. Also, one vertical scanning period includes a vertical effective display period consisting of a plurality of horizontal scanning periods, and a vertical blanking period in which no video signal AV is outputted to any of the source bus lines SL1 to SLn. Note that during the vertical blanking period, the potential of the video signal AV is generally set at white level.

Looking now at individual pixels, the voltage to be applied to the liquid crystal layer is inverted every frame period. In the case where the aforementioned dot-sequential drive system is employed, a period in which the video signal AV is applied to each of the source bus lines SL1 to SLn is short. Therefore, in some cases, the source bus lines might not be charged sufficiently. As a result, for example, in the case of the normally-white liquid crystal display device, the black potential (i.e., the potential corresponding to a display of black) is not sufficiently written to the pixel capacitances 61 included in the display section 600, resulting in display faults such as contrast reduction.

For the aforementioned display faults such as contrast reduction, some methods have been disclosed, in which the source bus lines SL1 to SLn are pre-charged (preliminarily charged) at a midpoint potential of the video signal AV during the horizontal blanking period (e.g., Japanese Laid-Open Patent Publication No. 2-204718). According to these, the video signal AV is sequentially outputted to the source bus lines SL1 to SLn after charging the source bus lines SL1 to SLn at the midpoint potential during the horizontal blanking period. Therefore, compared to the case of not being precharged, it is possible to reduce the change of the potential of the source bus lines SL1 to SLn to be charged by the source driver 300. Thus, the aforementioned display faults are suppressed from occurring.

In addition, because the display section 600 includes a number of TFTs 60 in the pixel formation portions, and the TFTs 60 are extremely small, there is a problem where display defects (hereinafter, also referred to as "pixel defects") readily occur during production of the active matrix liquid crystal display device. Examples of the display defects include generation of bright spots (bright spot defects) and generation of black spots (black spot defects), and in particular, the bright spot defects are extremely conspicuous and can be visually recognized as display faults. As shown in FIG. 13, the vertical scanning period includes the vertical blanking period during which a white level signal is generally outputted as the video signal AV. When a full-screen black display is presented by the liquid crystal display device, a black level signal is written and retained in pixel capacitances of pixel formation portions having no defects (hereinafter, referred to as "normal pixel portions". On the other hand, as for pixel portions with leakage between the drain terminal and the source terminal due to poor properties of the TFT 60 (hereinafter, referred to as "faulty pixel portions"), a white level signal is written during the vertical blanking period due to the leakage as shown in FIG. 13, although a black level signal is written during the vertical effective display period. Accordingly, the average level of the voltage applied to the liquid crystal in the faulty pixel portions is lower than the levels of the voltage applied to the liquid crystal in normal pixel portions around the faulty pixel portions. As a result, in the normally-white liquid crystal display device, display brightness of the faulty pixel portions is higher than that of the normal pixel portions therearound, so that bright spots are generated. On the other hand, as for the normally-black liquid crystal display device, black spots are generated.

For the above-described problem, some methods are disclosed, in which the signal level of the video signal AV is set at black level, rather than at white level, during the vertical blanking period (e.g., Japanese Laid-Open Patent Publication No. 1-128098). According to these, because the video signal AV is set at black level during the vertical blanking period, the display brightness of the faulty pixel portions is equal to or darker than that of the normal pixel portions therearound, so that bright spot defects are visually less recognizable. Furthermore, there are disclosed some methods in which the vertical blanking period is prolonged, during which the video signal AV is set at black level, thereby making the display brightness of the faulty pixel portions closer to the black level (e.g., Japanese Laid-Open Patent Publication No. 6-141269).

In addition, when an open-mode fault occurs between the source terminal and the drain terminal in the TFT 60, no voltage is applied to that faulty pixel portion. Accordingly, in the normally-white liquid crystal display device, the faulty pixel portion always appears as a bright spot. Conventionally, to correct such a pixel defect, the drain terminal of the TFT 60 and the source bus line are short-circuited (hereinafter, referred to as "source-drain short-circuiting"). When the pixel defect is corrected by source-drain short-circuiting, the video signal AV on the source bus line is constantly supplied to the drain terminal of the TFT 60, allowing the display brightness of the faulty pixel portion to consistently accord with the video signal AV on the source bus line. The video signal AV is applied to the source bus line for the most of time, and therefore the faulty pixel portion is visually less recognizable as a bright spot defect.

[Patent Document 1] Japanese Laid-Open Patent Publication No. 2-204718

[Patent Document 2] Japanese Laid-Open Patent Publication No. 1-128098

[Patent Document 3] Japanese Laid-Open Patent Publication No. 6-141269

DISCLOSURE OF THE INVENTION

Problems to be Solved by the Invention

However, when the pixel defect in the liquid crystal display device with the line common inversion system is corrected by source-drain short-circuiting, a bright spot is generated in the corrected pixel formation portion due to polarity inversion. The generation of the bright spot will be described with reference to FIGS. 14 and 15. FIG. 14 shows signal waveform diagrams for explaining a common electrode potential Vcom and a source bus line potential VSL with respect to their changes during a full-screen black display. In FIG. 14(A) and FIG. 14(B), the polarity inversion is performed in a period from the time indicated by character t1 (time t1) to the time indicated by character t2 (time t2) FIG. 14(A) is a signal waveform diagram for the common electrode potential Vcom changing from low level to high level, while FIG. 14(B) is a signal waveform diagram for the common electrode potential Vcom changing from high level to low level.

First, a description will be given with reference to FIG. 14(A). As shown in FIG. 14(A), the common electrode potential Vcom changes in the period from time t1 to time t2. In the pixel formation portion where the pixel defect has been corrected, the source bus line is connected to the drain terminal of the TFT 60, and therefore the difference between the common electrode potential Vcom and the source bus line potential VSL is equal to the voltage to be applied to the liquid crystal layer. Because prior to the polarity inversion, the common electrode potential Vcom is set at 0V, and the source bus line potential VSL is set at 3.95V (black level potential), a voltage of 3.95V is applied to the liquid crystal layer. The common electrode potential Vcom increases from 0V to 5.1V due to the polarity inversion. Because the source bus line is connected to the drain terminal of the TFT 60, the source bus line potential VSL also increases with the common electrode potential Vcom. However, there are parasitic capacitances between the gate terminal and the source terminal and between the gate terminal and the drain terminal, the increase in the source bus line potential VSL is smaller than the increase in the common electrode potential Vcom. Therefore, the source bus line potential VSL is increased to, for example, 8.05V after the polarity inversion. Thus, after the polarity inversion, the voltage to be applied to the liquid crystal layer is 2.95V. This voltage is maintained until the source driver 300 applies the video signal AV to the source bus line connected to the source terminal of the TFT 60. That is, the bright-spot state continues until the source driver 300 applies the video signal AV to the source bus line. The same can be said of the case as shown in FIG. 14(B) where the common electrode potential Vcom changes from high level to low level.

FIG. 15 shows signal waveform diagrams for explaining the common electrode potential Vcom and the source bus line potential VSL with respect to their changes during a full-screen neutral color display. FIG. 15(A) is a signal waveform diagram for the common electrode potential Vcom changing from low level to high level, while FIG. 15(B) is a signal waveform diagram for the common electrode potential Vcom changing from high level to low level. In this case also, the voltage to be applied to the liquid crystal layer after polarity inversion is lower than the voltage to be applied to the liquid crystal layer before the polarity inversion. Therefore, a color lighter than the neutral color is maintained until the video signal AV is applied to the source bus line.

The order in which the video signal AV is applied to the source bus lines SL1 to SLn in the conventional liquid crystal display device will now be described with reference to FIG. 16. As shown in FIG. 16, in any periods during which one of the gate bus lines GL1 to GLm is selected, the video signal AV is sequentially applied in the order from the source bus line SL1 closest to the gate driver 400 to the source bus line SLn furthest from the gate driver 400. Accordingly, for example, when there is a pixel defect in any TFT 60 connected at its source terminal to the source bus line SL1 and any TFT 60 connected at its source terminal to the source bus line SLn, the potential VSL1 of the source bus line SL1 and the potential VSLn of the source bus line SLn change as shown in FIG. 17.

FIG. 17 illustrates the video signal AV, sampling pulses SAM1, SAM2, . . . , SAMn for sampling the video signal AV, the common electrode potential Vcom, and the potentials VSL1 and VSLn of the source bus lines SL1 and SLn, with respect to their waveforms in two consecutive horizontal scanning periods. For ease of explanation, the first and the second of the two consecutive horizontal scanning periods are referred to herein as the "preceding horizontal scanning period" and the "following horizontal scanning period", respectively.

As shown in FIG. 17, at the end of the horizontal blanking period (the time indicated by character t2) in the preceding horizontal scanning period, the difference between the source bus line potential and the common electrode potential Vcom is 2.95V for both the source bus line SL1 and the source bus line SLn. Thereafter, the video signal AV is applied to the source bus line SL1 in accordance with the sampling pulse SAM1, so that the difference between the potential VSL1 of the source bus line SL1 and the common electrode potential Vcom is increased to 3.95V at the time indicated by character t3. On the other hand, the video signal AV is applied to the source bus line SLn in accordance with the sampling pulse SAMn, so that the difference between the potential VSLn of the source bus line SLn and the common electrode potential Vcom is maintained at 2.95V until the time indicated by character t5. Subsequently, at the time indicated by character t6, the difference between the potential VSLn of the source bus line SLn and the common electrode potential Vcom is increased to 3.95V.

At the end of the horizontal blanking period (the time indicated by character t7) in the following horizontal scanning period, the difference between the source bus line potential and the common electrode potential Vcom is also 2.95V for both the source bus line SL1 and the source bus line SLn. Thereafter, the video signal AV is applied to the source bus line SL1 in accordance with the sampling pulse SAM1, so that the difference between the potential VSL1 of the source bus line SL1 and the common electrode potential Vcom is increased to 3.95V at the time indicated by character t8. On the other hand, the video signal AV is applied to the source bus line SLn in accordance with the sampling pulse SAMn, so that the difference between the potential VSLn of the source bus line SLn and the common electrode potential Vcom is maintained at 2.95V until the time indicated by character t10. Subsequently, the difference between the potential VSLn of the source bus line SLn and the common electrode potential Vcom is increased to 3.95V at the time indicated by character t11.

As such, in the case of correcting the pixel defect by source-drain short-circuiting, the further the pixel formation portion is away from the gate driver 400, the longer the period in which to apply a voltage lower than a target voltage. As a result, bright spots are conspicuously generated in pixel formation portions further from the gate driver 400, so that visual quality of the entire display section is reduced. For the same reason, a similar phenomenon also takes place in pixel formation portions with leakage between the drain terminal and the source terminal due to poor properties of the TFT 60.

Furthermore, in the case where the source bus line potential changes with the common electrode potential Vcom as described above, leakage might occur at an analogue switch within the source driver 300. Such leakage at the analogue switch within the source driver 300 conceivably contributes to generation of bright spots. FIG. 18 is a diagram illustrating the configuration of the analogue switch within the source driver 300. The analogue switch includes a Pch transistor 81 and an Nch transistor 82. The leakage at the analogue switch will now be described with reference to FIGS. 14(A) and 18, regarding the case where polarity inversion is performed during a full-screen black display, so that the common electrode potential Vcom changes from low level to high level. As shown in FIG. 14(A), the source bus line potential VSL is 8.05V at and after the time indicated by character t2. At this time, the potential on the source driver 300 side is maintained at 3.95V, because a voltage of 10V is applied to the Pch transistor 81, thereby preventing current on the source bus line from flowing toward the source driver 300 side. On the other hand, as shown in FIG. 14(B) the source bus line potential VSL is −2.95V at and after the time indicated by character t2. At this time, the potential on the source driver 300 side is maintained at 1.15V. In this case, the source bus line potential VSL is lower than the power supply voltage of the Nch transistor 82, which is 0V, and therefore current on the source driver 300 side flows to the source bus line. Such a phenomenon also reduces visual quality.

Therefore, the present invention aims to allow a display device employing the dot-sequential drive system and the line common inversion system to suppress defects such as generation of bright spots and black spots from occurring at locations distant from the gate driver, resulting in reduction of visual quality when pixel defects are corrected by source-drain short-circuiting or any TFTs with poor properties are present.

Solution to the Problems

A first aspect of the present invention is directed to a drive circuit for a display device including a plurality of video signal lines for transmitting an externally inputted video signal representing an image to be displayed, a plurality of scanning signal lines crossing the plurality of video signal lines, a plurality of switching elements arranged in a matrix form at their corresponding intersections between the plurality of video signal lines and the plurality of scanning signal lines, a plurality of pixel electrodes connected to their respective switching elements, a common electrode commonly provided for the plurality of pixel electrodes so as to form predetermined capacitances with the plurality of pixel electrodes, the common electrode being alternately switched between a high potential voltage level and a low potential voltage level every predetermined period, and a display section for displaying the image, including the plurality of video signal lines, the plurality of scanning signal lines, the plurality of switching elements, the plurality of pixel electrodes, and the common electrode, the drive circuit comprising:

a scanning signal line drive circuit for selectively driving each of the plurality of scanning signal lines for the predetermined period; and a video signal line drive circuit for sequentially applying a voltage to the plurality of video signal lines as the video signal, while reversing a polarity of the video signal every the predetermined period, wherein the video signal line drive circuit reverses an order of applying the video signal to the plurality of video signal lines every the predetermined period.

In a second aspect of the invention, based on the first aspect of the invention, the video signal line drive circuit includes a shift register for shifting timing data that is externally inputted in order to generate a plurality of sampling pulses used for sequentially applying the video signal to the plurality of video signal lines, the shift register shifts the timing data in a reverse direction every the predetermined period, and the video signal is sequentially applied to the plurality of video signal lines in accordance with the plurality of sampling pulses generated in accordance with a direction in which to shift the timing data.

In a third aspect of the invention, based on the first aspect of the invention, the video signal line drive circuit is composed of a first video signal line drive circuit and a second video signal line drive circuit, the first video signal line drive circuit and the second video signal line drive circuit are alternately used every the predetermined period so as to sequentially apply the video signal to the video signal lines, and an order in which the first video signal line drive circuit applies the video signal to the video signal lines is opposite to an order in which the second video signal line drive circuit applies the video signal to the video signal lines.

A fourth aspect of the invention is directed to a display device comprising a plurality of video signal lines for transmitting an externally inputted video signal representing an image to be displayed, a plurality of scanning signal lines crossing the plurality of video signal lines, a plurality of switching elements arranged in a matrix form at their corresponding intersections between the plurality of video signal lines and the plurality of scanning signal lines, a plurality of pixel electrodes connected to their respective switching elements, a common electrode commonly provided for the plurality of pixel electrodes so as to form predetermined capacitances with the plurality of pixel electrodes, the common electrode being alternately switched between a high potential voltage level and a low potential voltage level every predetermined period, and a display section for displaying the image, including the plurality of video signal lines, the plurality of scanning signal lines, the plurality of switching elements, the plurality of pixel electrodes, and the common electrode, the display device comprising:

a scanning signal line drive circuit for selectively driving each of the plurality of scanning signal lines for the predetermined period; and a video signal line drive circuit for sequentially applying a voltage to the plurality of video signal lines as the video signal, while reversing a polarity of the video signal every the predetermined period, wherein the video signal line drive circuit reverses an order of applying the video signal to the plurality of video signal lines every the predetermined period.

In a fifth aspect of the invention, based on the fourth aspect of the invention, the video signal line drive circuit includes a shift register for shifting timing data that is externally inputted in order to generate a plurality of sampling pulses used for sequentially applying the video signal to the plurality of video signal lines, the shift register shifts the timing data in a reverse direction every the predetermined period, and the video signal is sequentially applied to the plurality of video signal lines in accordance with the plurality of sampling pulses generated in accordance with a direction in which to shift the timing data.

In a sixth aspect of the invention, based on the fourth aspect of the invention, the video signal line drive circuit is composed of a first video signal line drive circuit and a second video signal line drive circuit, the first video signal line drive circuit and the second video signal line drive circuit are alternately used every the predetermined period so as to sequentially apply the video signal to the video signal lines, and an order in which the first video signal line drive circuit applies the video signal to the video signal lines is opposite to an order in which the second video signal line drive circuit applies the video signal to the video signal lines.

In a seventh aspect of the invention, based on the fourth aspect of the invention, an image data-order reversal portion is further comprised for reversing a top-to-bottom order of the image data corresponding to the predetermined period every the predetermined period, and the video signal line drive circuit sequentially applies the video signal to the plurality of video signal lines in accordance with the image data having its top-to-bottom order reversed by the image data-order reversal portion every the predetermined period.

In an eighth aspect of the invention, based on the seventh aspect of the invention, the image data-order reversal portion includes a memory for storing the image data corresponding to at least the predetermined period.

In a ninth aspect of the invention, based on the fourth aspect of the invention, liquid crystal is used as a display medium.

In a tenth aspect of the invention, based on the ninth aspect of the invention, the display section, the video signal line drive circuit, and the scanning signal line drive circuit are provided on the same board.

In an eleventh aspect of the invention, based on the fourth aspect of the invention, drain terminals of the plurality of switching elements and the plurality of video signal lines are short-circuited to allow correction of pixel defects.

A twelfth aspect of the invention is directed to a drive method for a display device including a plurality of video signal lines for transmitting an externally inputted video signal representing an image to be displayed, a plurality of scanning signal lines crossing the plurality of video signal lines, a plurality of switching elements arranged in a matrix form at their corresponding intersections between the plurality of video signal lines and the plurality of scanning signal lines, a plurality of pixel electrodes connected to their respective switching elements, a common electrode commonly provided for the plurality of pixel electrodes so as to form predetermined capacitances with the plurality of pixel electrodes, the common electrodes being alternately switched between a high potential voltage level and a low potential voltage level every predetermined period, and a display section for displaying the image, including the plurality of video signal lines, the plurality of scanning signal lines, the plurality of switching elements, the plurality of pixel electrodes, and the common electrode, the method comprising:

a scanning signal line drive step for selectively driving each of the plurality of scanning signal lines for the predetermined period; and a video signal line drive step for sequentially applying a voltage to the plurality of video signal lines as the video signal, while reversing a polarity of the video signal every the predetermined period, wherein in the video signal line drive step, an order of applying the video signal to the plurality of video signal lines is reversed every the predetermined period.

In a thirteenth aspect of the invention, based on the twelfth aspect of the invention, an image data-order reversal step is further comprised for reversing a top-to-bottom order of the image data corresponding to the predetermined period every the predetermined period, and in the video signal line drive step, the video signal is sequentially applied to the plurality of video signal lines in accordance with the image data having its top-to-bottom order reversed by the image data-order reversal step every the predetermined period.

EFFECT OF THE INVENTION

According to the first aspect of the invention, the order of applying the video signal to the video signal lines is switched every predetermined period. Therefore, it is possible to solve the problem where bright spots are conspicuously generated in a portion of the display section when the video signal lines and the drain terminals of the switching elements are short-circuited. Also, it is possible to minimize the difference in duration of the bright spots or the black spots between the video signal lines, thereby evening out the rate of generation of the bright spots and black spots over the entire display section. Thus, it is possible to alleviate the bright spots or the black spots to such an extent as to be unrecognizable, enhancing visual quality of the entire display section.

According to the second aspect of the invention, the video signal line drive circuit is provided with a bidirectional shift register for reversing the direction in which to shift the timing date used for generating the sampling pulses every predetermined period. Thus, it is possible to realize a drive circuit capable of achieving effects similar to those achieved in the first aspect of the invention without increasing its size.

According to the third aspect of the invention, the video signal line drive circuit includes the first video signal line drive circuit and the second video signal line drive circuit, and the first video signal line drive circuit and the second video signal line drive circuit are opposite to each other in terms of the order of applying the video signal to the video signal lines, and used alternately every predetermined period to apply the video signal to the video signal lines. Therefore, the first video signal line drive circuit and the second video signal line drive circuit may be provided with a unidirectional shift register. As a result, it becomes possible to readily realize a drive circuit capable of achieving effects similar to those achieved in the first aspect of the invention.

According to the fourth aspect of the invention, as in the first aspect of the invention, bright spots or black spots in a display device are alleviated to such an extent as to be unrecognizable, thereby enhancing visual quality of the entire display section.

According to the fifth aspect of the invention, it is possible to realize a display device capable of achieving effects similar to those achieved in the fourth aspect of the invention without increasing its size.

According to the sixth aspect of the invention, it is possible to readily realize a display device capable of achieving effects similar to those achieved in the fourth aspect of the invention.

According to the seventh aspect of the invention, the image data-order reversal portion is provided for reversing the order of the image data every predetermined period. Furthermore, the video signal is applied to the video signal lines in accordance with the image data having its order reversed every predetermined period. Thus, although the order of applying the video signal to the video signal lines needs to be reversed every predetermined period, the video signal can be appropriately applied to each of the video signal lines in accordance with the application order.

According to the eighth aspect of the invention, the image data-order reversal portion includes a RAM for storing image data corresponding to a predetermined period. Thus, it is possible to reliably reverse the order of the image data every predetermined period.

According to the ninth aspect of the invention, it is possible to realize a liquid crystal display device capable of achieving effects similar to those achieved in the fourth aspect of the invention.

According to the tenth aspect of the invention, the display section, the scanning signal line drive circuit, and the video signal line drive circuit are provided on the same board. Thus, it is possible to realize a display device with reduced size, capable of achieving effects similar to those achieved in the ninth aspect of the invention.

According to the eleventh aspect of the invention, it is possible to realize a display device capable of achieving effects similar to those achieved in the fourth aspect of the invention, and allowing correction of pixel defects by short-circuiting the drain terminals of the switching elements and the video signal lines.

DESCRIPTION OF THE REFERENCE CHARACTERS

Figure 1:
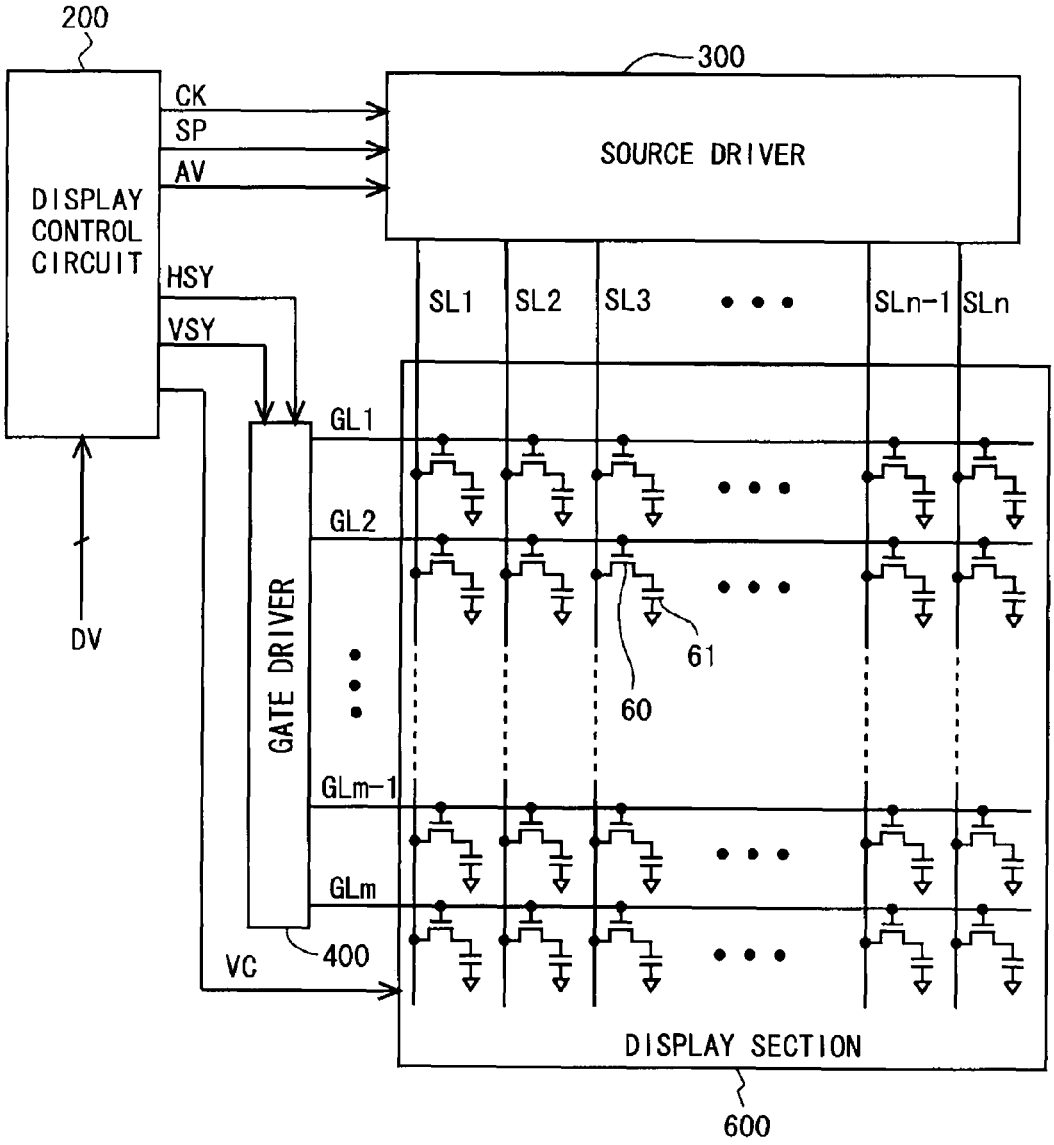
FIG. 1 is a block diagram illustrating the configuration of a substantial part of an active matrix liquid crystal display device according to an embodiment of the present invention.

20 control circuit
21 line memory
30 shift register
31 sampling circuit
60 TFT
61 pixel capacitance
300 source driver
400 gate driver
600 display section
AV video signal
SAM1 to SAMn sampling pulses
SL1 to SLn source bus lines
Vcom common electrode potential

BEST MODE FOR CARRYING OUT THE INVENTION

Hereinafter, an embodiment of the present invention will be described with reference to the accompanying drawings.

<1. Configuration and Operation of the Liquid Crystal Display Device>

Figure 2:
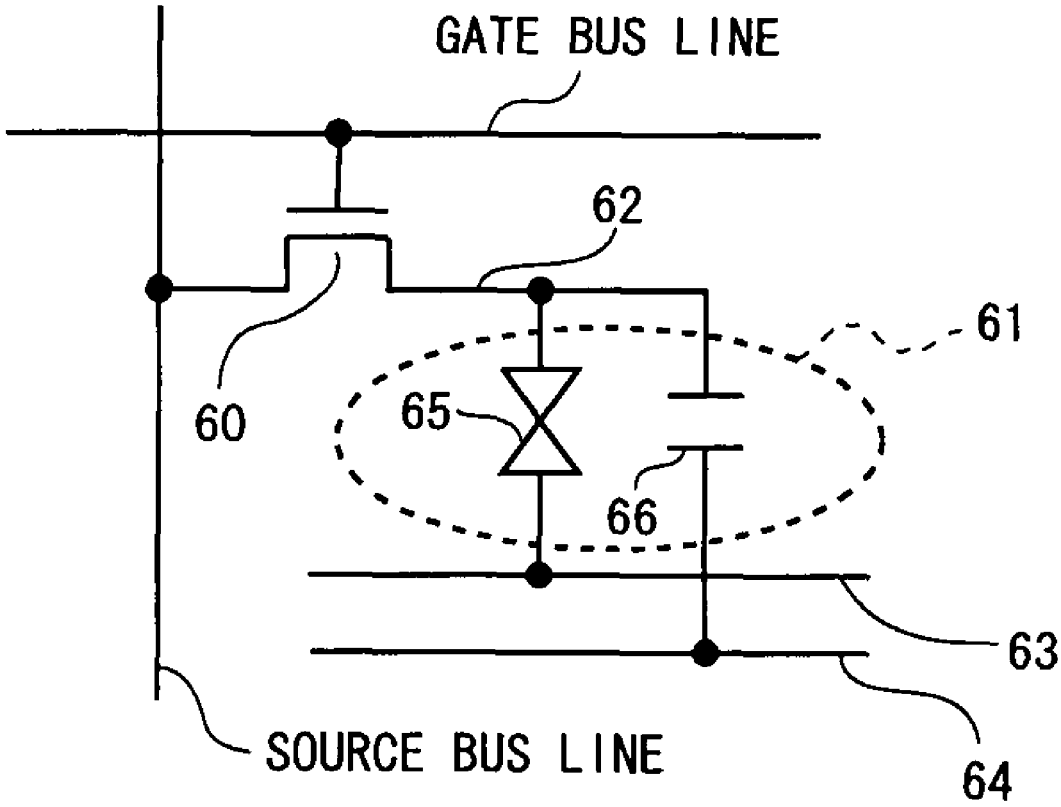
FIG. 2 is a circuit diagram illustrating the configuration of a pixel formation portion in the embodiment.

FIG. 1 is a block diagram illustrating the configuration of a substantial part of an active matrix liquid crystal display device according to an embodiment of the present invention, along with an equivalent circuit of a display section. The liquid crystal display device includes a display control circuit 200, a source driver 300, a gate driver 400, and a display section 600. The display section 600 includes a plurality (n) of source bus lines SL1 to SLn and a plurality (m) of gate bus lines GL1 to GLm, which (perpendicularly) cross each other. The source bus lines SL1 to SLn are connected to the source driver 300, while the gate bus lines GL1 to GLm are connected to the gate driver 400. In addition, the display section 600 includes a plurality (m×n) of pixel formation portions provided at their corresponding intersections between the source bus lines SL1 to SLn and the gate bus lines GL1 to GLm. As shown in FIG. 2, each pixel formation portion includes a TFT 60 as a switching element, a pixel electrode 62 connected to a drain terminal of the TFT 60, a common electrode 63 commonly provided for the pixel formation portions, and an auxiliary capacitance electrode 64. The pixel electrode 62 and the common electrode 63 form a liquid crystal capacitance 65, while the pixel electrode 62 and the auxiliary capacitance electrode 64 form an auxiliary capacitance 66. Also, the liquid crystal capacitance 65 and the auxiliary capacitance 66 constitute a pixel capacitance 61. In addition, the TFT 60 has a gate terminal connected to the gate bus line that passes through its corresponding intersection, and a source terminal connected to the source bus line that passes through the corresponding intersection. When an open-mode fault or suchlike occurs between the source terminal and the drain terminal in any TFT 60, a pixel defect is corrected by source-drain short-circuiting.

The display control circuit 200 externally receives image data DV, and outputs a video signal AV, along with a horizontal synchronization signal HSY, a vertical synchronization signal VSY, a clock signal CK and a start pulse signal SP, which are used for controlling the timing of image display on the display section 600, as well as a common electrode drive signal VC, which is used for driving the common electrode 63. The source driver 300 receives the video signal AV, the clock signal CK, and the start pulse signal SP, which are outputted from the display control circuit 200, and applies the video signal AV to the video signal lines SL1 to SLn of the display section 600 in order to drive the display section 600. To sequentially select each of the gate bus lines GL1 to GLm for one horizontal scanning period, the gate driver 400 repeats applying an active scanning signal to the gate bus lines GL1 to GLm in cycles of one vertical scanning period, in accordance with the horizontal synchronization signal HSY and the vertical synchronization signal VSY, which are outputted from the display control circuit 200.

<2. Display Control Circuit>

Figure 3:
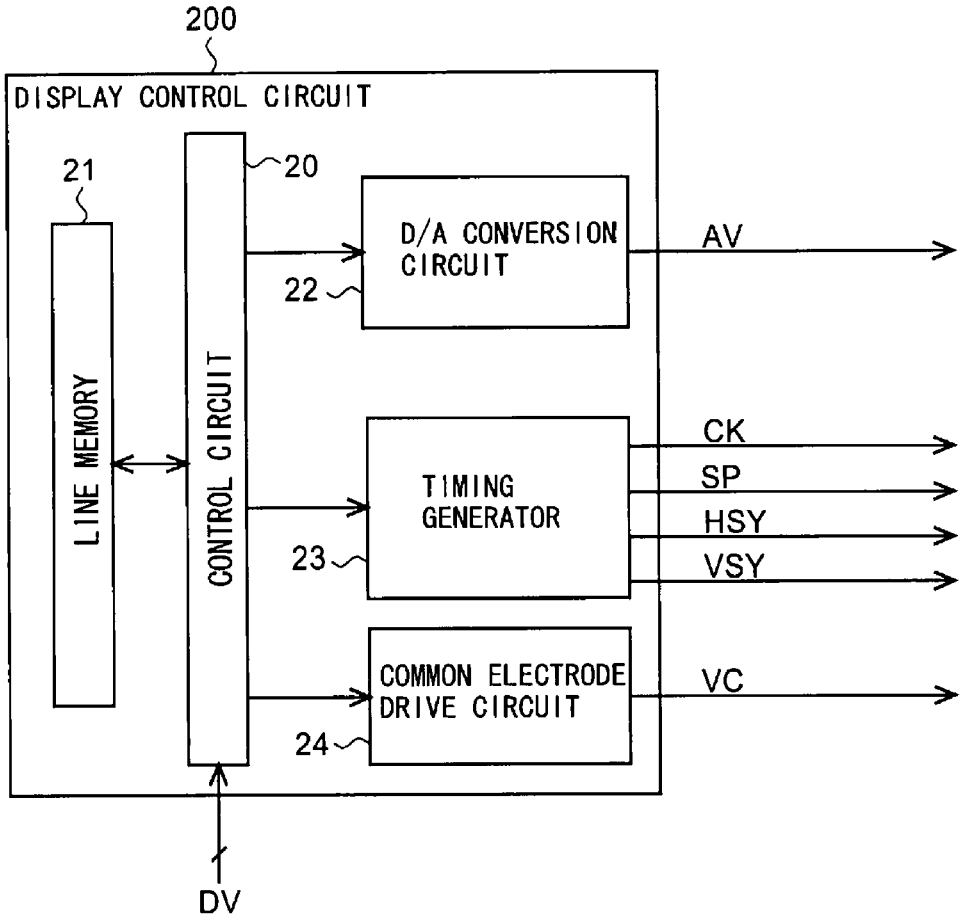
FIG. 3 is a block diagram illustrating the configuration of a display control circuit in the embodiment.

FIG. 3 is a block diagram illustrating the configuration of the display control circuit 200 in the present embodiment. The display control circuit 200 includes a control circuit 20, a line memory 21, a D/A conversion circuit 22, a timing generator 23, and a common electrode drive circuit 24. The control circuit 20 externally receives image data DV, and controls operations of the D/A conversion circuit 22, the timing generator 23, and the common electrode drive circuit 24, such that an image based on the image data DV is displayed on the display section 600. In addition, the control circuit 20 stores the externally received image data DV to the line memory 21 in units of one horizontal scanning period. Then, the control circuit 20 reads the data stored in the line memory 21, while switching between the first-in first-out method and the first-in last-out method every horizontal scanning period, and supplies the data to the D/A conversion circuit 22. Therefore, the line memory 21 can store the image data DV corresponding to at least one horizontal scanning period. The D/A conversion circuit 22 converts the digital data supplied by the control circuit 20 into analog data, and outputs it as the video signal AV. The timing generator 23 outputs the clock signal CK and the start pulse signal SP to control the operation of the source driver 300, while outputting the horizontal synchronization signal HSY and the vertical synchronization signal VSY to control the operation of the gate driver 400. The common electrode drive circuit 24 outputs the common electrode drive signal VC to drive the common electrode 63. Note that an image data-order reversal portion is implemented by the control circuit 20 and the line memory 21.

<3. Source Driver>

Figure 4:
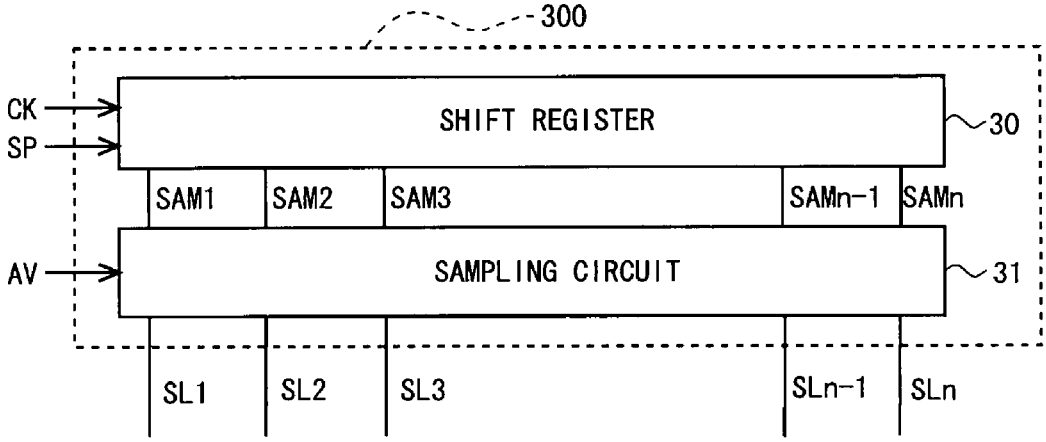
FIG. 4 is a block diagram illustrating the configuration of a source driver in the embodiment.

FIG. 4 is a block diagram illustrating the configuration of the source driver 300 in the present embodiment. The source driver 300 includes a shift register 30 and a sampling circuit 31. The shift register 30 receives the start pulse signal SP and the clock signal CK, which are outputted from the display control circuit 200, and sequentially outputs sampling pulses SAM1 to SAMn. The sampling circuit 31 receives the video signal AV outputted from the display control circuit 200, and sequentially applies a drive video signal to the source bus lines SL1 to SLn in accordance with the sampling pulses SAM1 to SAMn outputted from the shift register 30.

<4. Drive Method>

Figure 5:
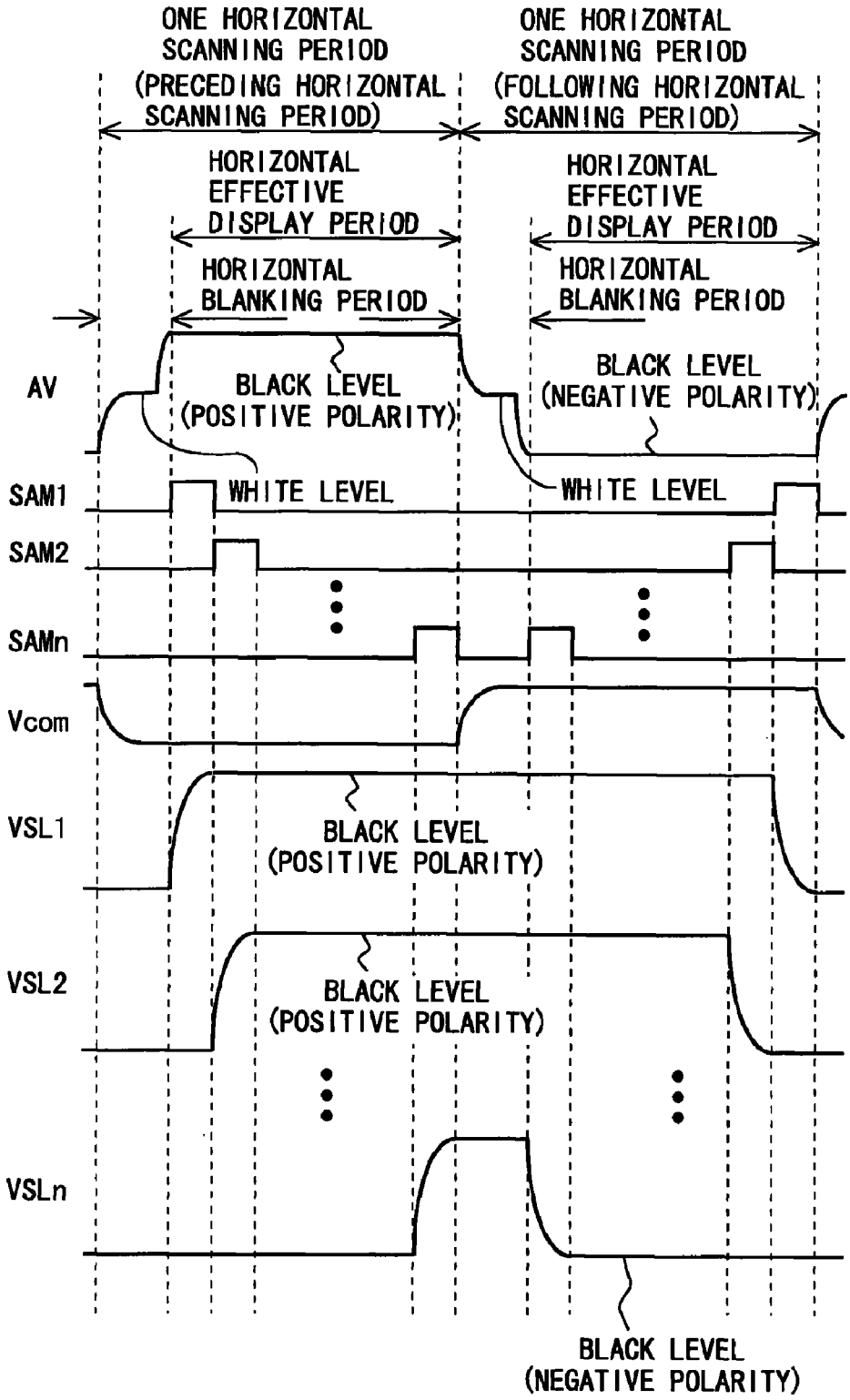
FIG. 5 is a signal waveform diagram during a full-screen black display in the embodiment.

Next, the drive method according to the present embodiment will be described. FIG. 5 is a signal waveform diagram during a full-screen black display in the present embodiment. Waveforms shown in FIG. 5 are those of the video signal AV, the sampling pulses SAM1, SAM2, . . . , SAMn for sampling the video signal AV, a common electrode potential Vcom, and potentials VSL1, VSL2, . . . , VSLn of the source bus lines SL1, SL2, . . . , SLn in two consecutive horizontal scanning periods. As shown in FIG. 5, the common electrode potential Vcom is switched between high and low potential levels every horizontal scanning period. In the horizontal blanking period during the preceding horizontal scanning period, the common electrode potential Vcom falls from high potential level to low potential level. On the other hand, the potential of the video signal AV rises from negative black level to white level, and further rises from the white level to positive black level before the horizontal effective display period is reached. In the horizontal effective display period during the preceding horizontal scanning period, the potential of the video signal AV is maintained at the positive black level, and the common electrode potential Vcom is maintained at the low potential level. Also, in the horizontal effective display period during the preceding horizontal scanning period, each of the sampling pulses SAM1, SAM2, . . . , SAMn is activated for a predetermined period. At this time, the sampling pulses are activated in the order: SAM1, SAM2, . . . , SAMn. As a result, the source bus lines are sequentially charged to the positive black level in the order from the source bus line SL1 closest to the gate driver 400 to the source bus line SLn furthest from the gate driver 400.

When the horizontal effective display period of the preceding horizontal scanning period ends, so that the horizontal blanking period of the following horizontal scanning period starts, the common electrode potential Vcom rises from the low potential level to the high potential level. On the other hand, the potential of the video signal AV falls from the positive black level to the white level, and further falls from the white level to the negative black level before the horizontal effective display period is reached. In the horizontal effective display period during the following horizontal scanning period, the potential of the video signal AV is maintained at the negative black level, while the common electrode potential Vcom is maintained at the high potential level. Also, in the horizontal effective display period during the following horizontal scanning period, each of the sampling pulses SAM1, SAM2, . . . SAMn is activated for a predetermined period. At this time, the sampling pulses are activated in the order: SAMn, . . . , SAM2, SAM1. As a result, the source bus lines are sequentially charged to the negative black level in the order from the source bus line SLn furthest from the gate driver 400 to the source bus line SL1 closest to the gate driver 400.

Figure 6:
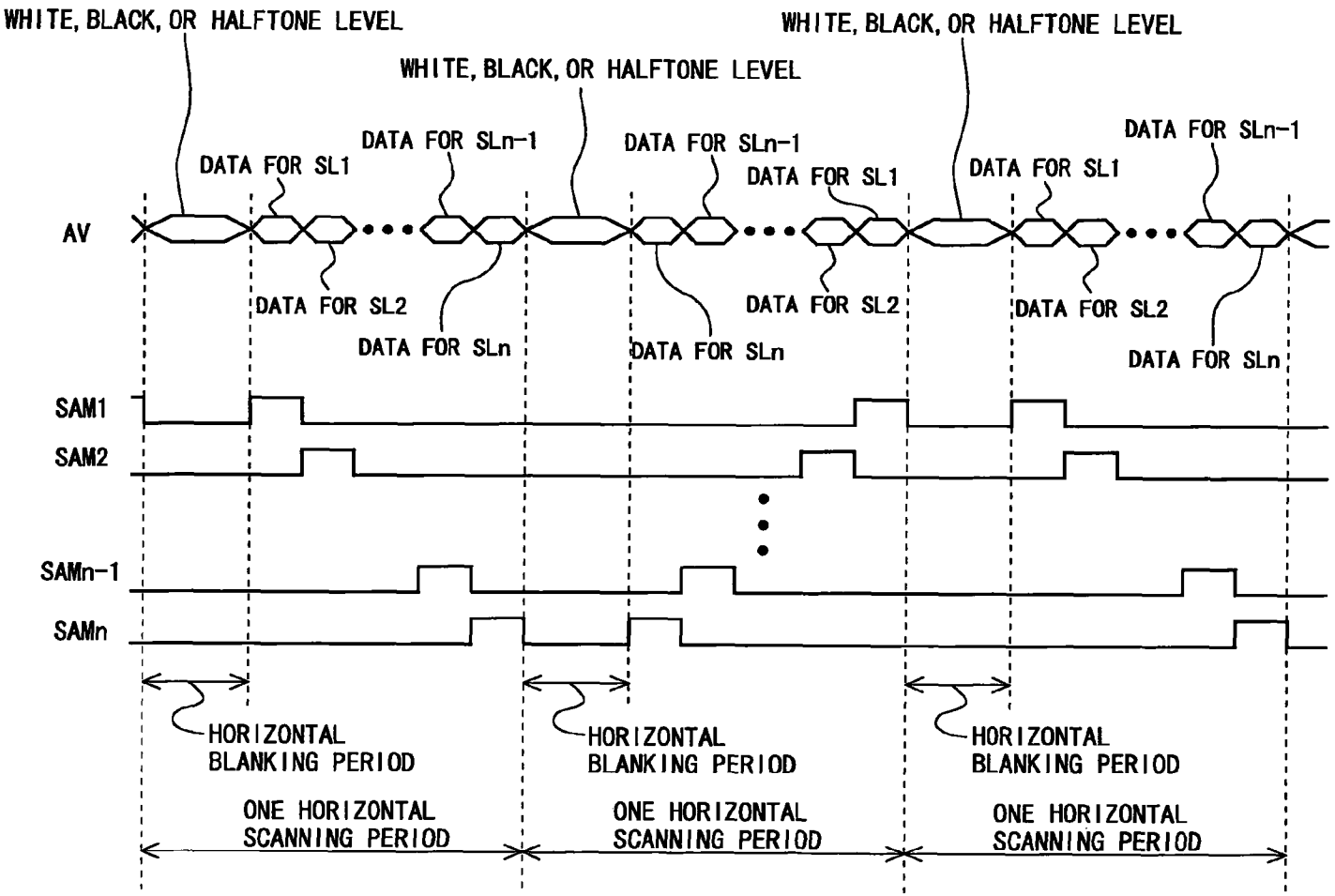
FIG. 6 is a signal waveform diagram for the source driver in the embodiment.

In this manner, the timing order for activating the sampling pulses in the preceding horizontal scanning period is SAM1, SAM2, . . . , SAMn, while the order in the following horizontal scanning period is SAMn, . . . , SAM2, SAM1. That is, the video signal AV is sampled in accordance with the sampling pulses, while reversing the order every horizontal scanning period. This will be further described with reference to FIG. 6. FIG. 6 is a signal waveform diagram for the source driver 300 in the present embodiment. As shown in FIG. 6, when the sampling pulses are outputted in the order: SAM1, SAM2, . . . , SAMn, in a given horizontal scanning period, the sampling pulses are outputted in the order: SAMn, . . . , SAM2, SAM1, in the next horizontal scanning period. The video signal AV to be outputted to the source bus lines SL1 to SLn is inputted to the source driver 300 in accordance with the output timing of the sampling pulses SAM1 to SAMn. That is, the video signal AV to be inputted to the source driver 300 is switched every horizontal scanning period.

The above-described drive method is implemented by allowing the display control circuit 200 to output the video signal AV, such that the video signal AV that is inputted to the source driver 300 in accordance with the order of the source bus lines SL1, SL2, . . . , SLn, and the video signal AV that is inputted to the source driver 300 in accordance with the order of the source bus lines SLn, . . . , SL2, SL1 are switched every horizontal scanning period. In the present embodiment, this is implemented by providing the line memory 21 in the display control circuit 200 as shown in FIG. 3. Specifically, the control circuit 20 in the display control circuit 200 externally receives the image data DV, which is a digital signal, and stores it to the line memory 21. The line memory 21 stores the image data DV corresponding to one horizontal scanning period. The control circuit 20 reads the image data DV stored in the line memory 21, while reversing the order every horizontal scanning period, and supplies the read data to the D/A conversion circuit 22. Here, for example, when the image data DV is read in accordance with the first-in first-out method during a given horizontal scanning period, the image data DV may be read in accordance with the first-in last-out method during the next horizontal scanning period. The D/A conversion circuit 22 performs D/A (digital to analog) conversion on the data supplied from the control circuit 20, and outputs the D/A-converted analog signal as the video signal AV. In addition, the shift register 30 in the source driver 300 is a bidirectional shift register. The order of outputting the sampling pulses is switched every horizontal scanning period. For example, when the sampling pulses are outputted in the order: SAM1, SAM2, . . . , SAMn, in a given horizontal scanning period, the sampling pulses are outputted in the order: SAMn, SAMn−1, . . . , SAM1, in the next horizontal scanning period.

<5. Function>

Figure 7:
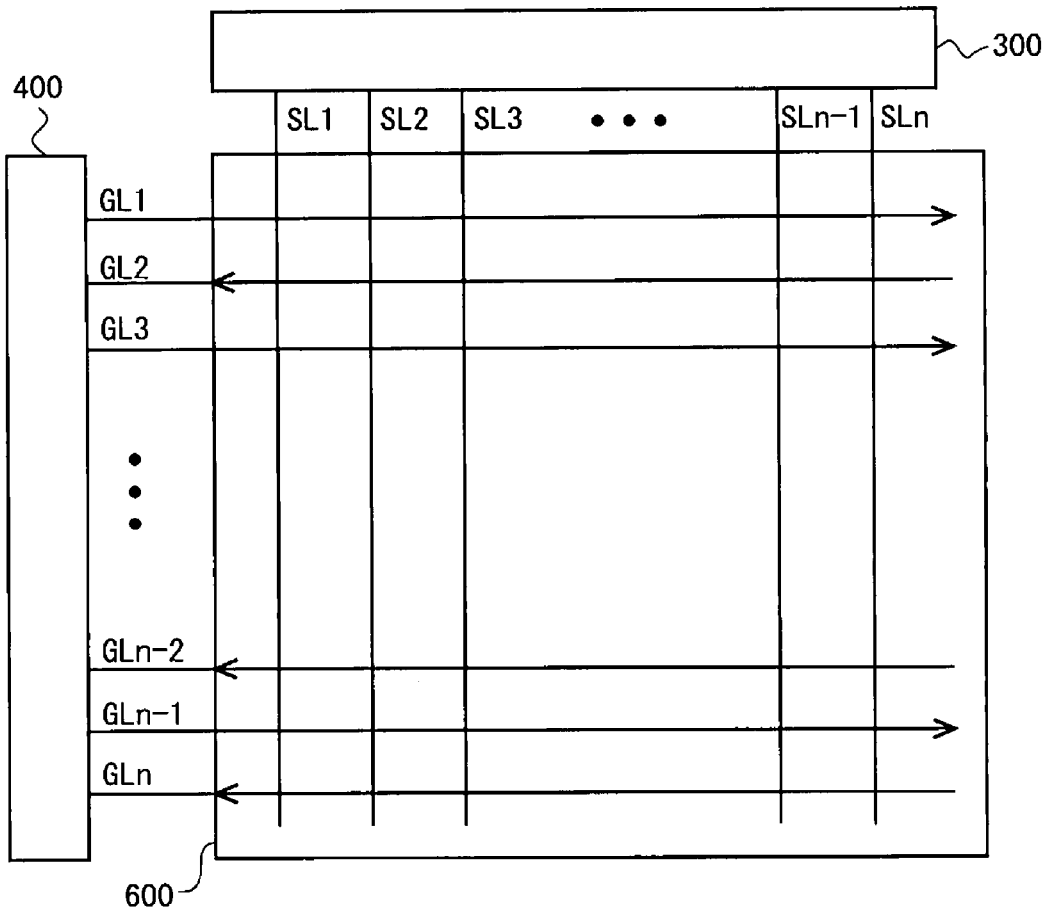
FIG. 7 is a conceptual diagram for explaining the order of applying a video signal to source bus lines in the embodiment.

Next, the function according to the above-described drive method will be described. FIG. 7 is a conceptual diagram for explaining the order of applying the video signal AV to the source bus lines SL1 to SLn in the present embodiment. During the period in which the first-row gate bus line GL1 is selected, the video signal AV is sequentially applied from the left to the right in FIG. 7. That is, the video signal AV is sequentially applied in the order from the source bus line SL1 closest to the gate driver 400 to the source bus line SLn furthest from the gate driver 400. During the period in which the second-row gate bus line GL2 is selected, the video signal AV is sequentially applied from the right to the left in FIG. 7. That is, the video signal AV is sequentially applied in the order from the source bus line SLn furthest from the gate driver 400 to the source bus line SL1 closest to the gate driver 400. In this manner, during the periods in which an odd-row gate bus line is selected, the video signal AV is sequentially applied in the order from the source bus line SL1 closest to the gate driver 400 to the source bus line SLn furthest from the gate driver 400. On the other hand, during the periods in which an even-row gate bus line is selected, the video signal AV is sequentially applied in the order from the source bus line SLn furthest from the gate driver 400 to the source bus line SL1 closest to the gate driver 400. Thus, in the present embodiment, the order of applying the video signal AV to the source bus lines SL1 to SLn is switched every horizontal scanning period.

Figure 8:
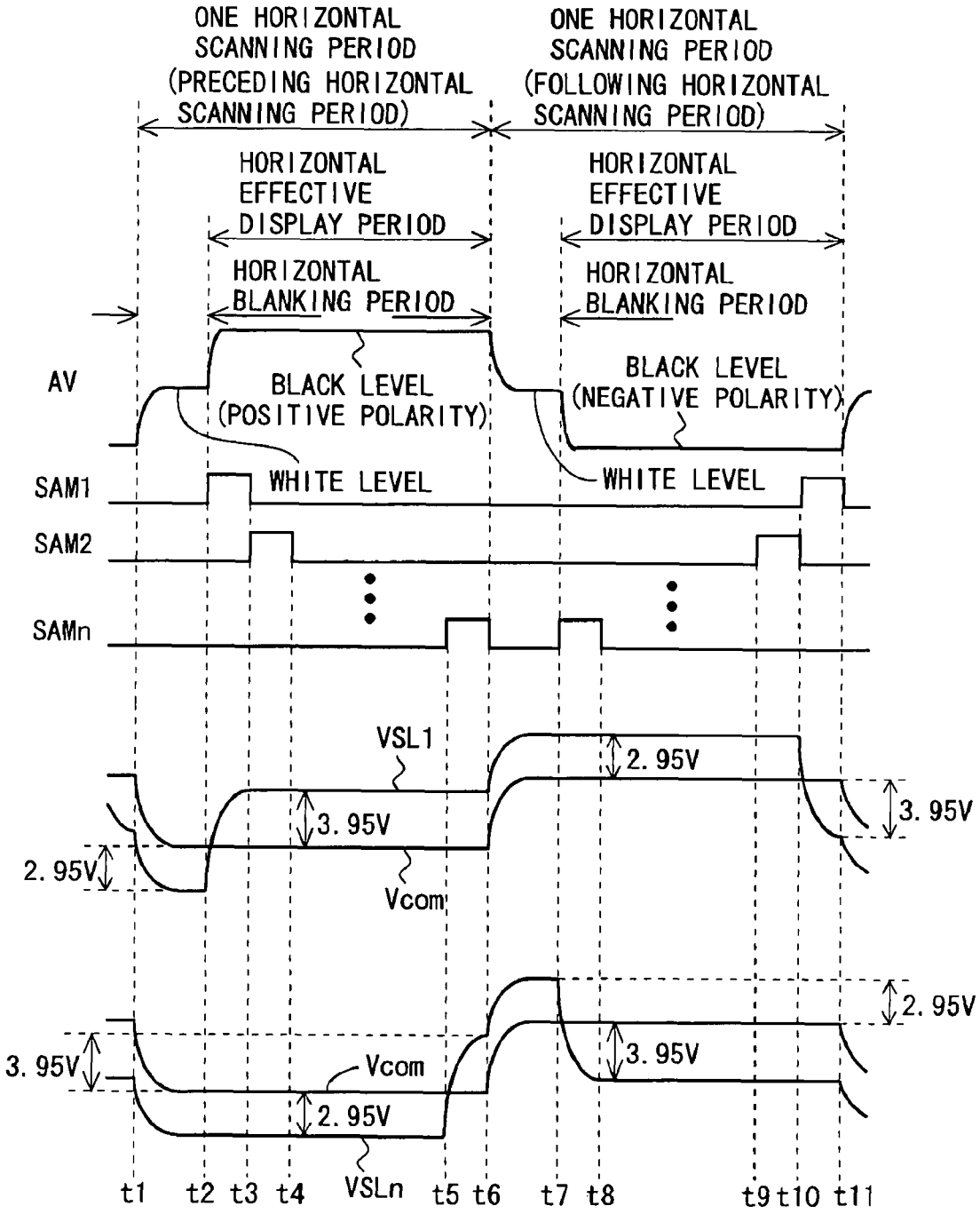
FIG. 8 is a signal waveform diagram for explaining changes of source bus line potentials during a full-screen black display in the embodiment.

Consider now the case where a defect occurs in a TFT 60 provided at the intersection between the first-column source bus line SL1 and a given gate bus line, and also in a TFT 60 provided at the intersection between the n'th-column source bus line SLn and a given gate bus line. Note that these defects are corrected by source-drain short-circuiting. FIG. 8 is a signal waveform diagram for explaining changes of source bus line potentials in accordance with a change of the common electrode potential Vcom during a full-screen black display.

In the horizontal blanking period (from the time indicated by character t1 to the time indicated by character t2) during the preceding horizontal scanning period, the common electrode potential Vcom falls from high potential level to low potential level, and the potentials VSL1 and VSLn of the source bus lines SL1 and SLn also fall accordingly. At the end of the horizontal blanking period (the time indicated by character t2) during the preceding horizontal scanning period, the difference between the source bus line potential and the common electrode potential Vcom is 2.95V for both the source bus line SL1 and the source bus line SLn. Thereafter, the video signal AV is applied to the source bus line SL1 in accordance with the sampling pulse SAM1, and therefore, at the time indicated by character t3, the difference between the potential VSL1 of the source bus line SL1 and the common electrode potential Vcom is increased to 3.95V. On the other hand, the video signal AV is applied to the source bus line SLn in accordance with the sampling pulse SAMn, and therefore, until the time indicated by character t5, the difference between the potential VSLn of the source bus line SLn and the common electrode potential Vcom is maintained at 2.95V. Subsequently, at the time indicated by character t6, the difference between the potential VSLn of the source bus line SLn and the common electrode potential Vcom is increased to 3.95V.

In the horizontal blanking period (from the time indicated by character t6 to the time indicated by character t7) during the following horizontal scanning period, the common electrode potential Vcom rises from low potential level to high potential level, and the potentials VSL1 and VSLn of the source bus lines SL1 and SLn also rise accordingly. At the end of the horizontal blanking period (the time indicated by character t7) during the following horizontal scanning period, the difference between the source bus line potential and the common electrode potential Vcom is 2.95V for both the source bus line SL1 and the source bus line SLn. Thereafter, the video signal AV is applied to the source bus line SLn in accordance with the sampling pulse SAMn, and therefore, at the time indicated by character t8, the difference between the potential VSLn of the source bus line SLn and the common electrode potential Vcom is increased to 3.95V. On the other hand, the video signal AV is applied to the source bus line SL1 in accordance with the sampling pulse SAM1, and therefore, until the time indicated by character t10, the difference between the potential VSL1 of the source bus line SL1 and the common electrode potential Vcom is maintained at 2.95V. Subsequently, at the time indicated by character t11, the difference between the potential VSL1 of the source bus line SL1 and the common electrode potential Vcom is increased to 3.95V.

As such, as for a period, in which a voltage lower than a target voltage is applied, in the two consecutive horizontal scanning periods, there is no difference between the source bus line SL1 closest to the gate driver 400 and the source bus line SLn furthest from the gate driver 400. Conventionally, in the source bus line SLn furthest from the gate driver 400, bright spots appear for most of one horizontal scanning period, but in the present embodiment, the period in which the bright spots appear is reduced by approximately half.

<6. Effects>

As described above, according to the present embodiment, the order of activating the sampling pulses SAM1, SAM2, . . . , SAMn outputted from the shift register 30 of the source driver 300 is switched every horizontal scanning period. Therefore, the order in which the video signal AV is applied to the source bus lines SL1 to SLn is switched every horizontal scanning period. Specifically, in the case where the video signal AV is applied in the order from the source bus line closest to the gate driver 400 to the source bus line furthest from the gate driver 400 in a given horizontal scanning period, the video signal AV is applied in the order from the source bus line furthest to the gate driver 400 to the source bus line closest to the gate driver 400 in the next horizontal scanning period. Therefore, in the case where pixel defects are corrected by source-drain short-circuiting, the difference in duration of the bright spots between the source bus lines is minimized. Also, it is possible to solve the problem of the source bus line furthest from the gate driver 400, where the bright spots remain for most of one horizontal scanning period. As a result, the bright spots are alleviated to such an extent as to be unrecognizable by the naked eye, enhancing visual quality of the entire display section.

<7. Variants>

<7.1 First Variant>

Figure 9:
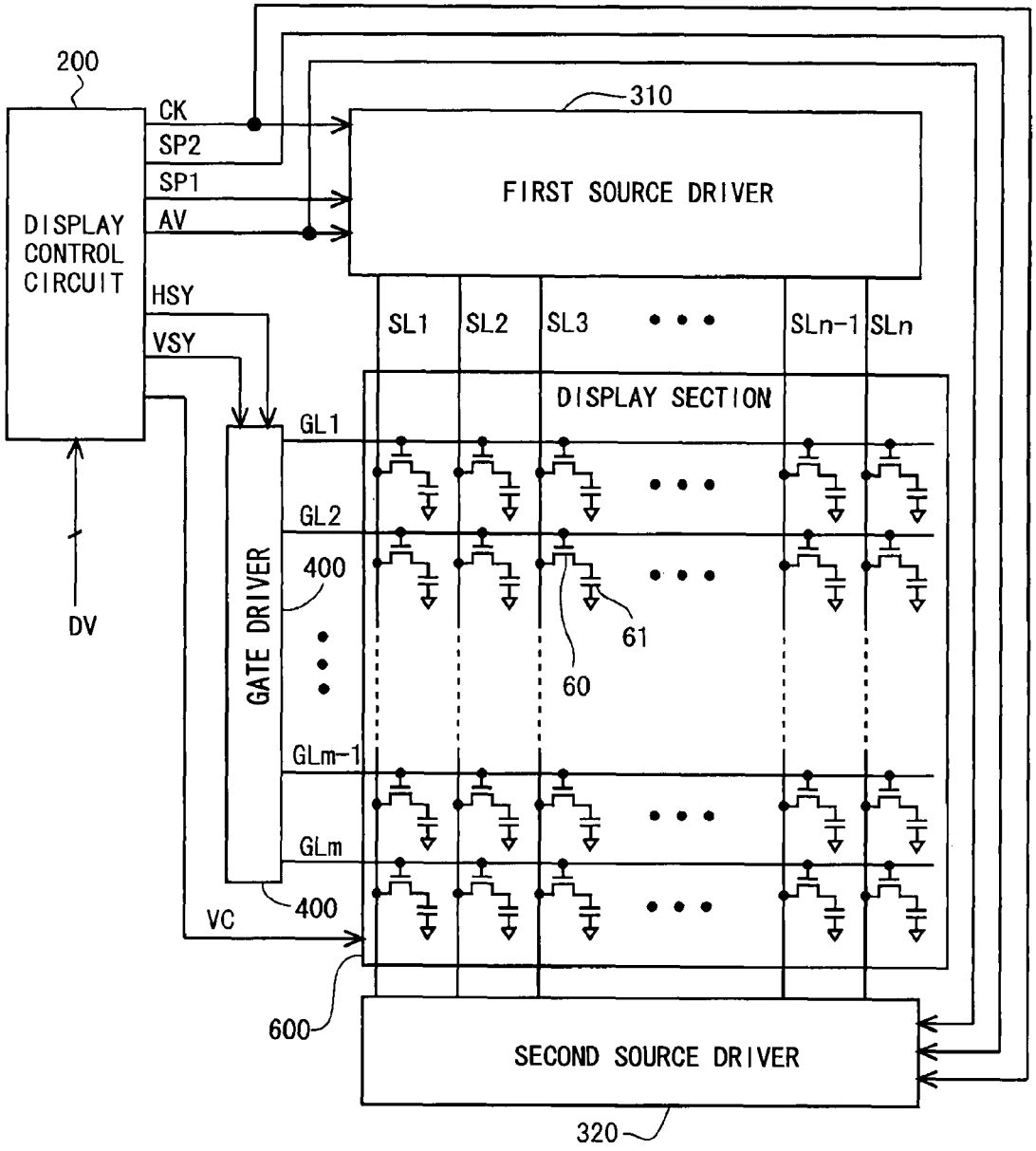
FIG. 9 is a block diagram illustrating the configuration of a substantial part of an active matrix liquid crystal display device according to the first variant.
Figure 10:
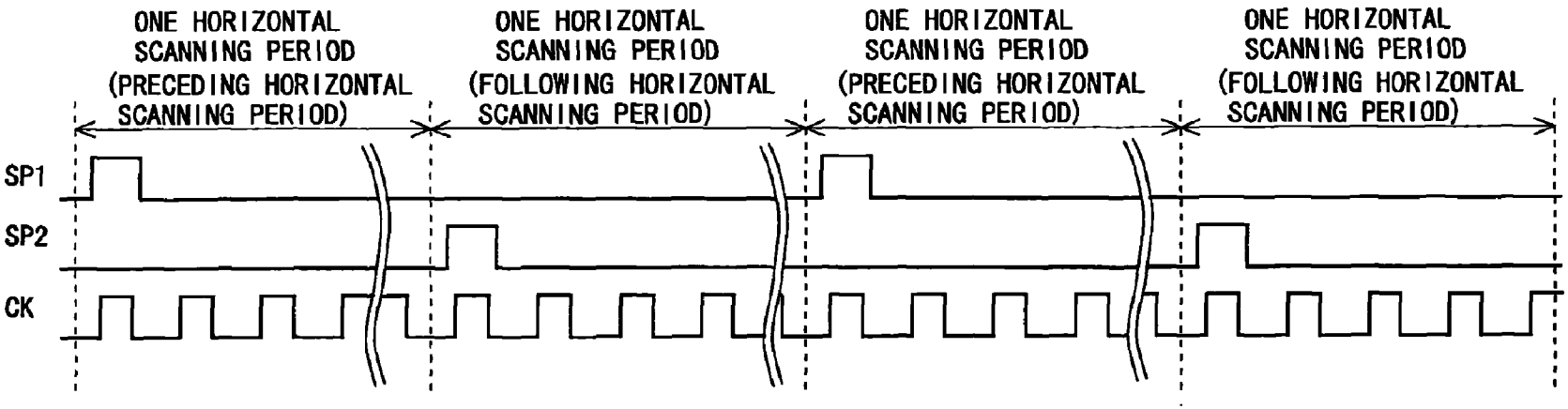
FIG. 10 is a signal waveform diagram in the first variant.
Figure 11:
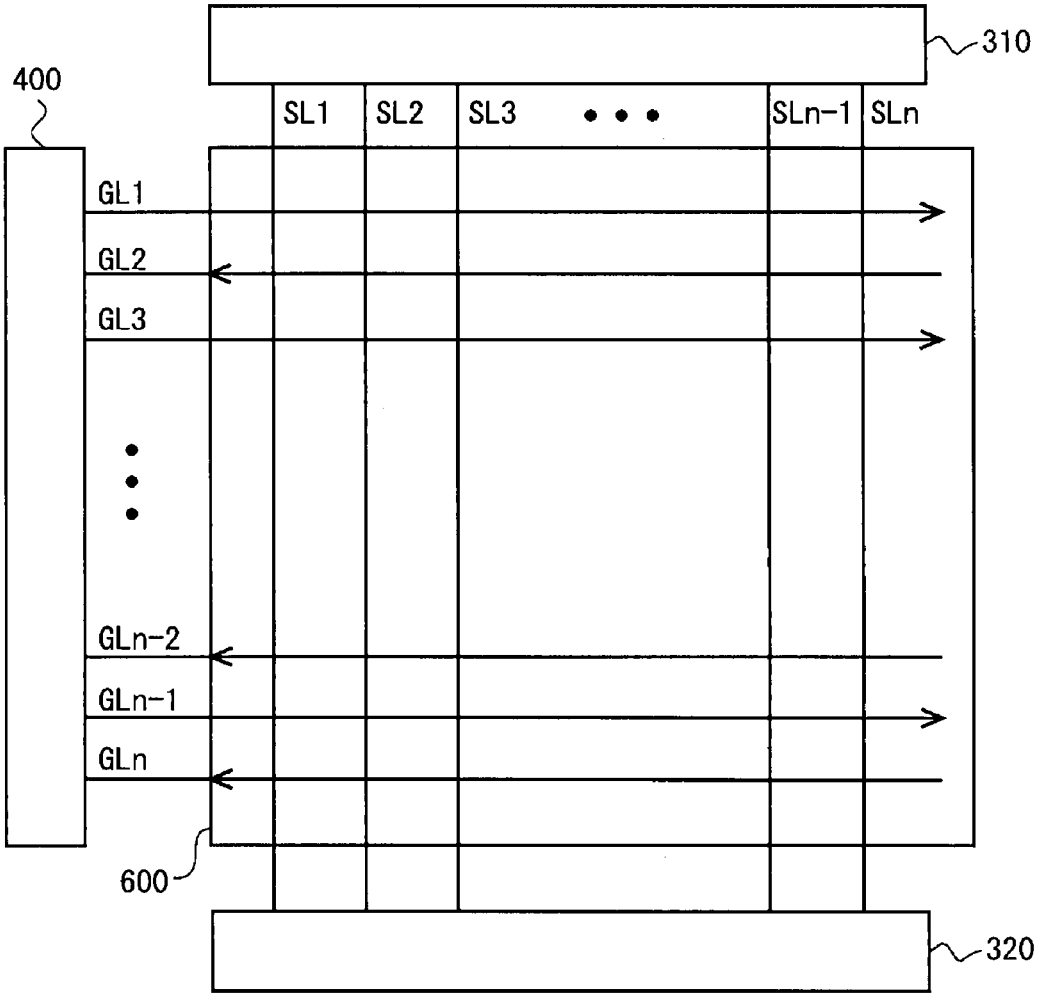
FIG. 11 is a conceptual diagram for explaining the order of applying a video signal to source bus lines in the first variant.

Next, a variant of the above embodiment will be described. FIG. 9 is an overall configuration diagram for a first variant. In the present variant, a first source driver 310 and a second source driver 320 are provided in place of the source driver 300 in the above embodiment as shown in FIG. 1. Each of the source bus lines SL1 to SLn is connected at one end to the first source driver 310, and at the other end to the second source driver 320. Also, a first start pulse signal SP1 is inputted to the first source driver 310, while a second start pulse signal SP2 is inputted to the second source driver 320. FIG. 10 is a signal waveform diagram for the first start pulse signal SP1, the second start pulse signal SP2, and the shift clock CK in the present variant. As shown in FIG. 10, the first start pulse signal SP1 and the second start pulse signal SP2 are activated once per two horizontal scanning periods. For example, in the case where the first start pulse signal SP1 is activated in the preceding horizontal scanning period, the second start pulse signal SP2 is activated in the following horizontal scanning period. As a result, the video signal AV is applied by the first source driver 310 to each of the source bus lines SL1 to SLn in the preceding horizontal scanning period. At this time, the video signal AV is sequentially applied in the order from the source bus line SL1 closest to the gate driver 400 to the source bus line SLn furthest from the gate driver 400. On the other hand, the video signal AV is applied by the second source driver 320 to each of the source bus lines SL1 to SLn in the following horizontal scanning period. At this time, the video signal AV is sequentially applied in the order from the source bus line SLn furthest from the gate driver 400 to the source bus line SL1 closest to the gate driver 400. As a result, as shown in FIG. 11, in any periods in which an odd-row gate bus line is selected, the video signal AV is sequentially applied in the order from the source bus line SL1 closest to the gate driver 400 to the source bus line SLn furthest from the gate driver 400. On the other hand, in any periods in which an even row is selected, the video signal AV is sequentially applied in the order from the source bus line SLn furthest from the gate driver 400 to the source bus line SL1 closest to the gate driver 400. Note that in the above embodiment, the shift register 30 in the source driver 300 is a bidirectional shift register. In the present variant, the first source driver 310 and the second source driver 320 do not have to include a bidirectional shift register, and a unidirectional shift register may be included. Thus, the first variant can be readily achieved compared to the above embodiment.

<7.2 Second Variant>

Figure 12:
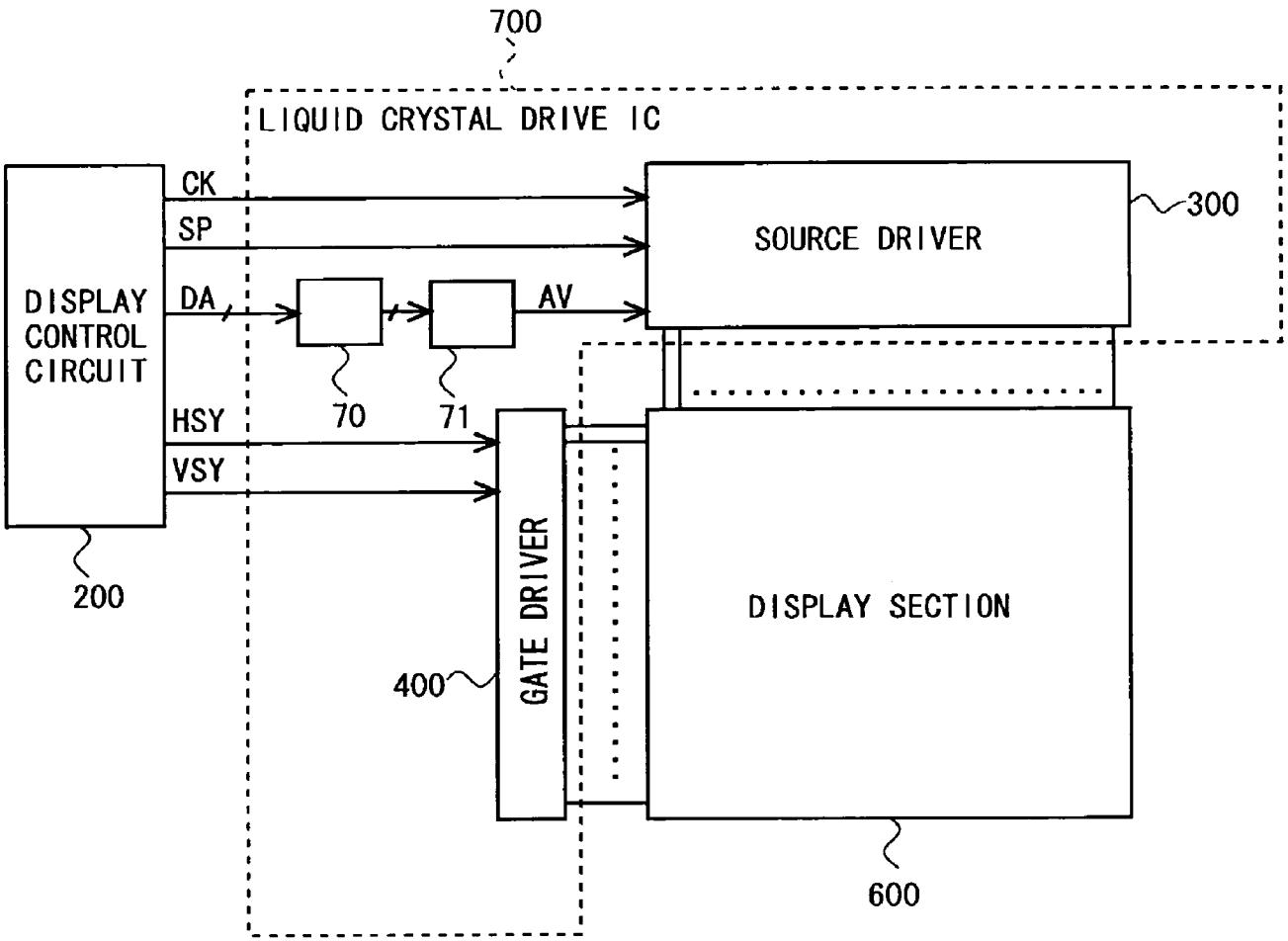
FIG. 12 is a block diagram illustrating the configuration of a substantial part of an active matrix liquid crystal display device according to a second variant.
Figure 13:
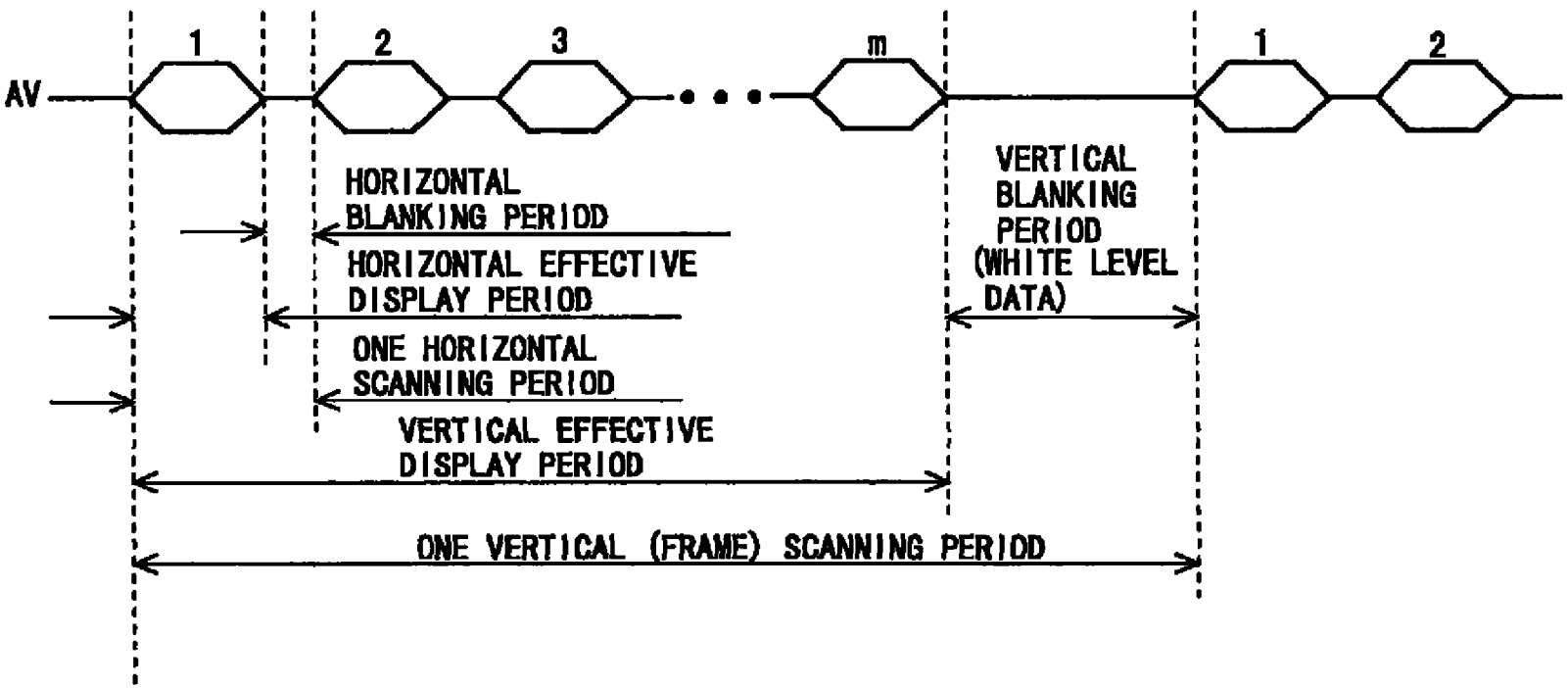
Fig.13 CONVENTIONAL ART
FIG. 13 is a signal waveform diagram for a video signal in the conventional art.
Figure 14A:
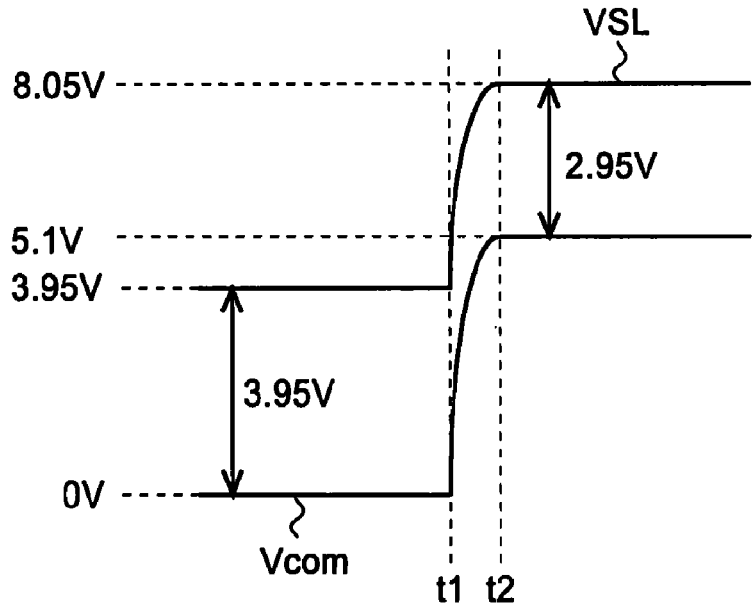
FIG. 14A is a signal waveform diagram showing a change of the source bus line potential during a full-screen black display in the conventional art in accordance with a common electrode potential changing from low level to high level.
Figure 14B:
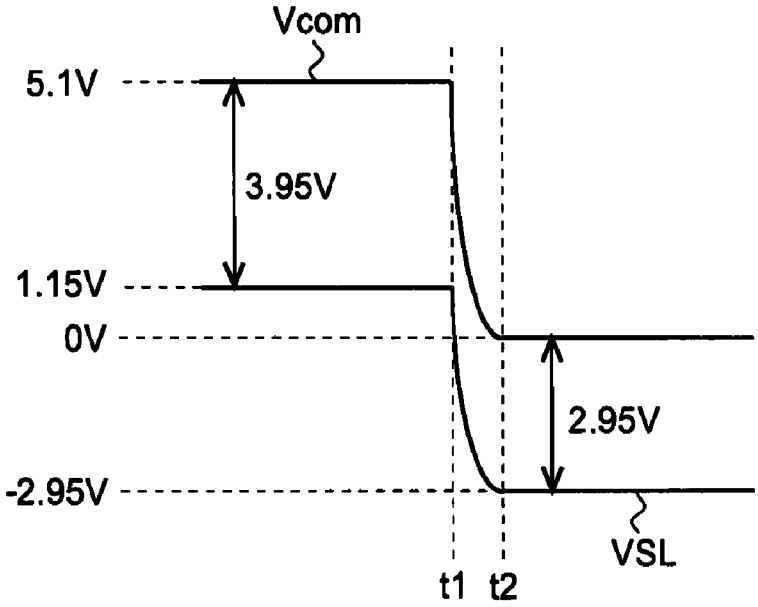
FIG. 14B is a signal waveform diagram for explaining a change of the source bus line potential during a full-screen black display in the conventional art in accordance with a common electrode potential changing from high level to low level.
Figure 15A:
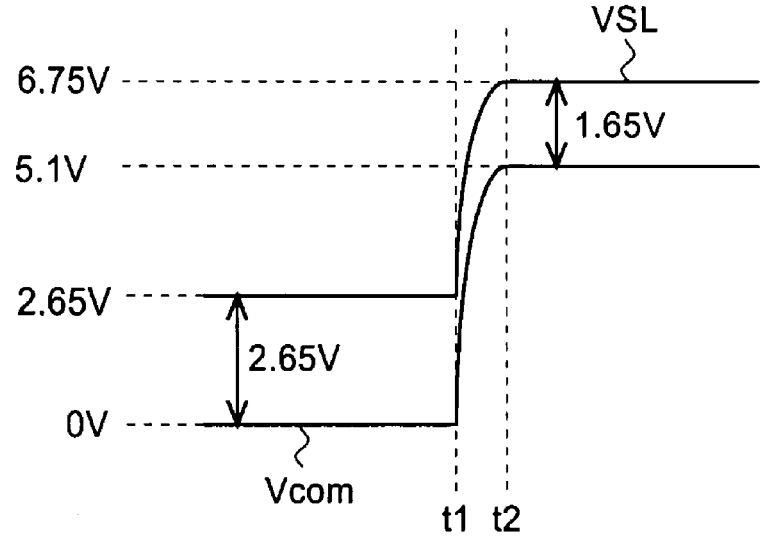
FIG. 15A is a signal waveform diagram showing a change of the source bus line potential during a full-screen neutral color display in the conventional art in accordance with a common electrode potential changing from low level to high level.
Figure 15B:
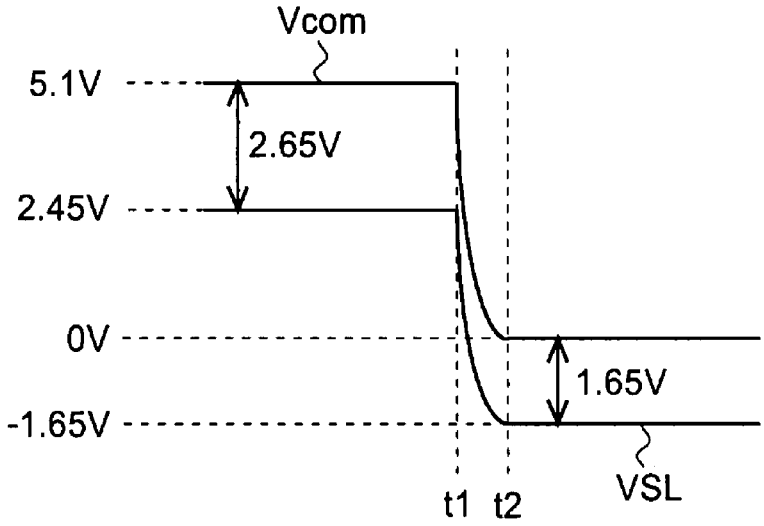
FIG. 15B is a signal waveform diagram for explaining a change of the source bus line potential during a full-screen neutral color display in the conventional art in accordance with a common electrode potential changing from high level to low level.
Figure 16:
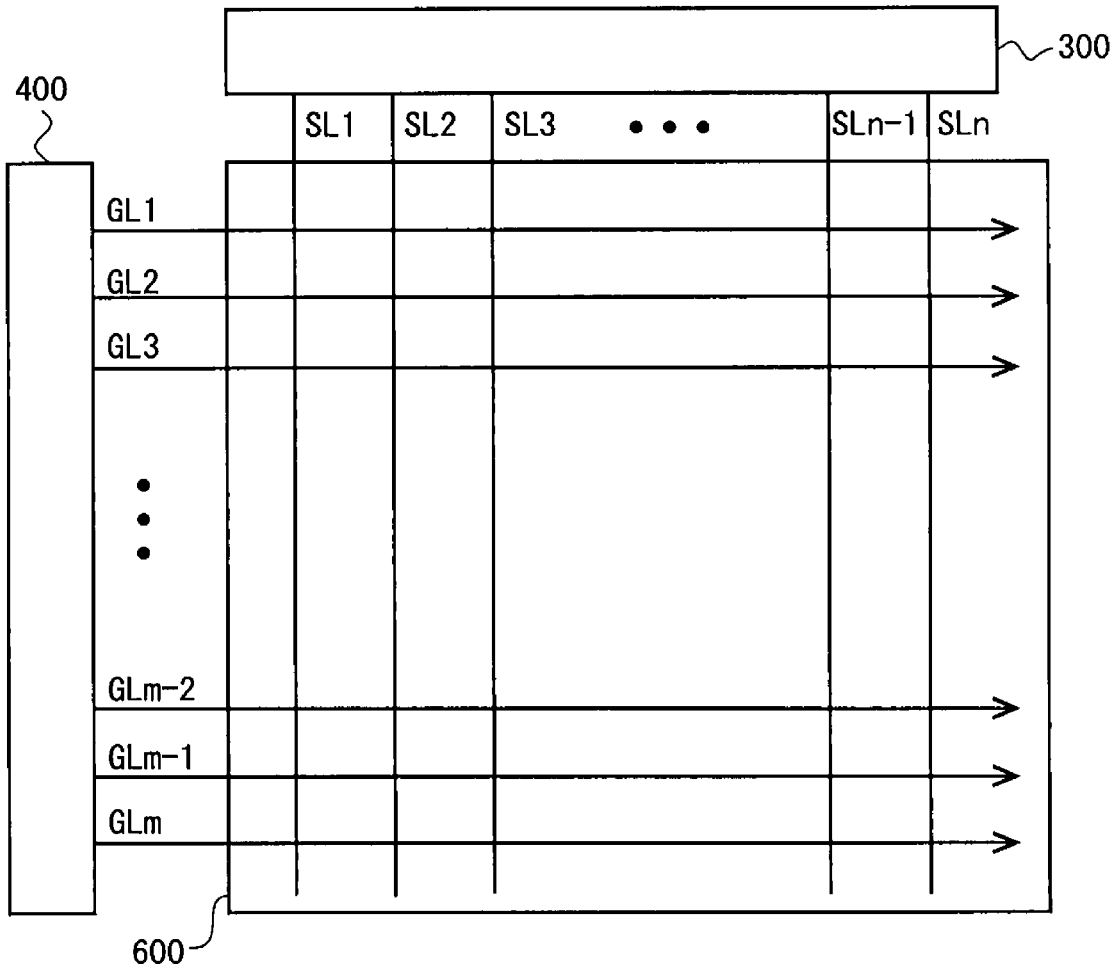
FIG. 16 is a conceptual diagram for explaining the order of applying a video signal to source bus lines in the conventional art.
Figure 17:
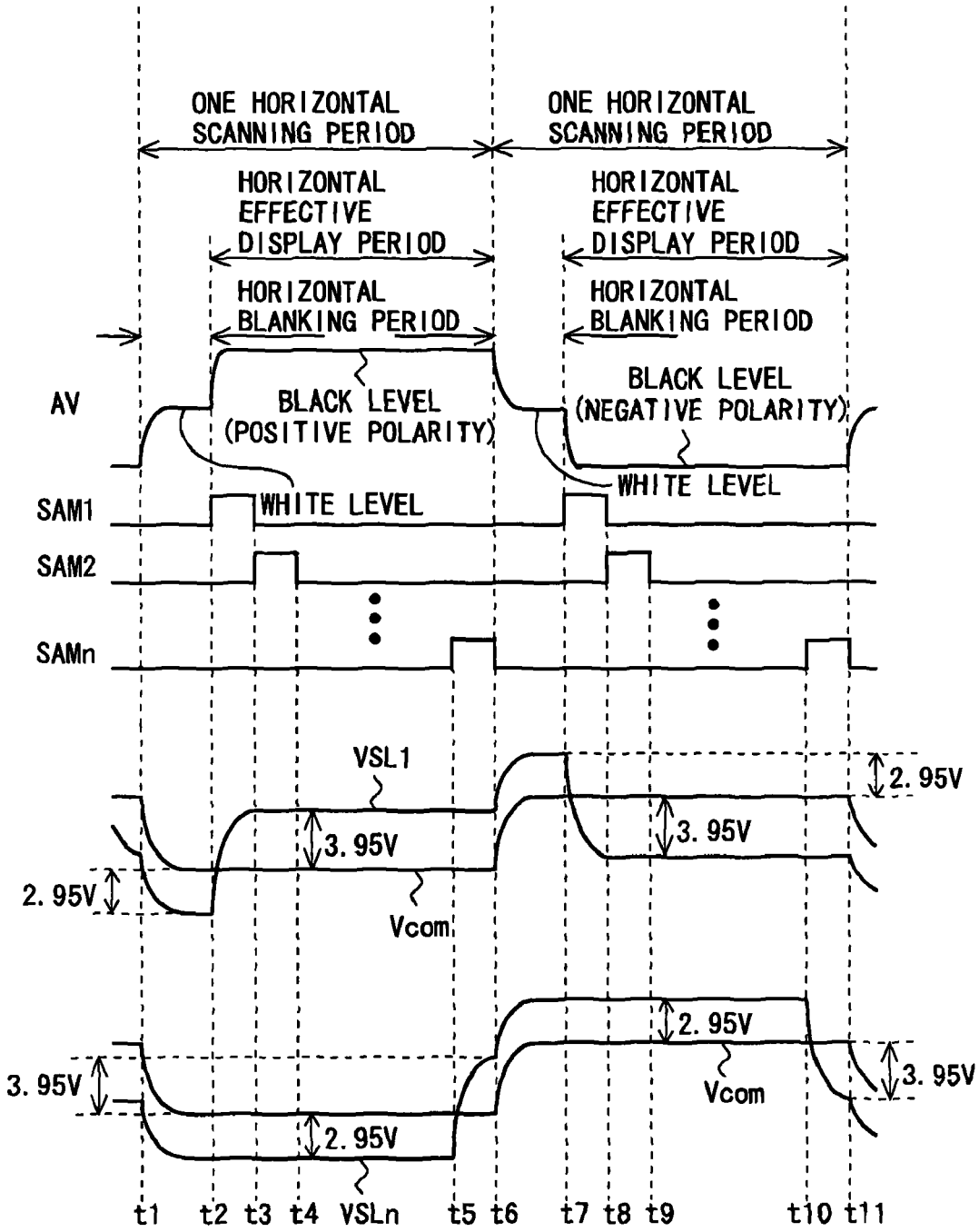
FIG. 17 is a signal waveform diagram for explaining changes of the source bus line potentials in the conventional art.
Figure 18:
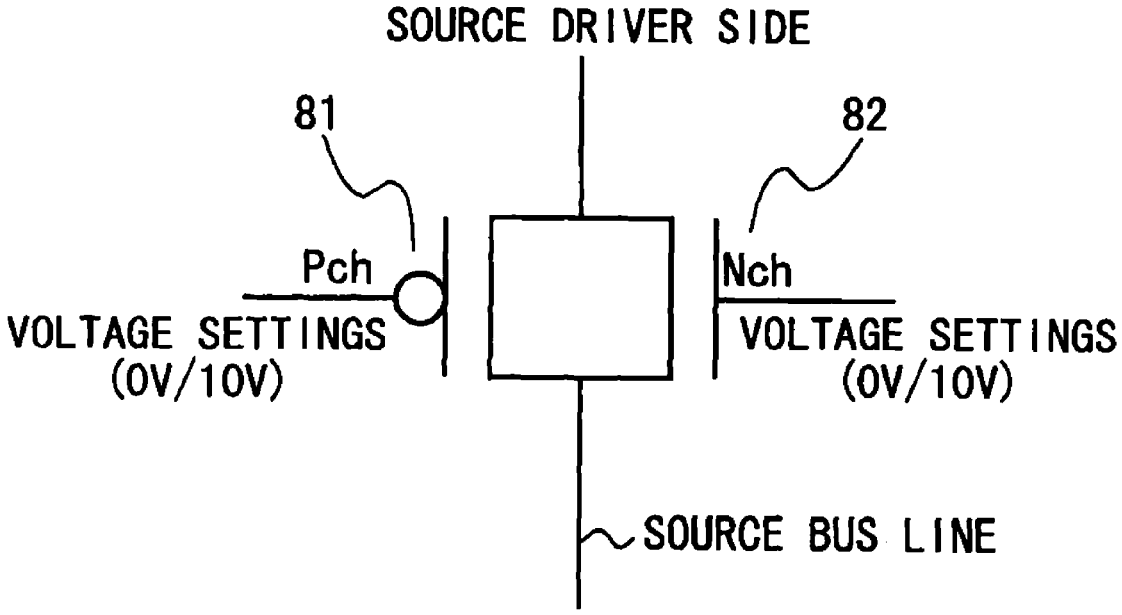
FIG. 18 is a diagram illustrating the configuration of an analogue switch within the source driver.

In the above embodiment, the line memory 21 is provided in the display control circuit 200 in order to switch the video signal AV that is to be inputted to the source driver 300 every horizontal scanning period, but the present invention is not limited to this. For example, as shown in FIG. 12, it is so configured that a liquid crystal drive IC 700 including the source driver 300 and the gate driver 400 may be provided with an image data-order reversal portion (image data-order reversal portion) 70 for reversing the order of data in a digital image signal DA, which is outputted from the display control circuit 200, every horizontal scanning period, and a D/A conversion portion 71 for converting data outputted from the image data-order reversal portion 70 into an analog video signal AV. The image data-order reversal portion 70 implements the same functions as those implemented by the control circuit 20 and the line memory 21 in the above embodiment as shown in FIG. 3. Thus, as in the above embodiment, the video signal AV inputted to the source driver 300 can be switched every horizontal scanning period as shown in FIG. 6.

<8. Others>

In the above embodiment, the video signal AV is inputted in analog format to the source driver 300, but the present invention is not limited to this. It is also possible that a digital video signal is inputted to the source driver 300, and an analog video signal AV that is to be applied to each of the source bus lines SL1 to SLn is selected in the source driver 300 in accordance with the digital video signal.

Also, the above embodiment has been described with respect to the liquid crystal display device in which pixel defects are corrected by source-drain short-circuiting, but the present invention is not limited to this. As described above, in the case where there is any TFT 60 with poor properties, defects such as generation of bright spots and black spots may occur for the same reason as in the case of source-drain short-circuiting. In such a case, the present invention makes it possible to suppress generation of bright spots and black spots, thereby enhancing visual quality.

Furthermore, in the above embodiment, the source driver 300 is configured such that sampling is sequentially performed on the source bus lines SL1 to SLn one by one, but the present invention is not limited to this. Sampling may be sequentially performed on a plurality of lines, e.g., two lines, at one time from among the source bus lines SL1 to SLn. With one or more than one line at a time, sampling is still sequentially applied to a plurality of video signal lines.

The invention claimed is:

1. A drive circuit for a display device including a plurality of video signal lines for transmitting an externally inputted video signal representing an image to be displayed, a plurality of scanning signal lines crossing the plurality of video signal lines, a plurality of switching elements arranged in a matrix form at their corresponding intersections between the plurality of video signal lines and the plurality of scanning signal lines, a plurality of pixel electrodes connected to their respective switching elements, and a display section for displaying the image, including the plurality of video signal lines, the plurality of scanning signal lines, the plurality of switching elements, the plurality of pixel electrodes, and a common electrode, the drive circuit comprising:

a scanning signal line drive circuit for selectively driving each of the plurality of scanning signal lines for a predetermined period; and a video signal line drive circuit for sequentially applying a voltage to the plurality of video signal lines as the video signal, while reversing a polarity of the video signal every the predetermined period, wherein the video signal line drive circuit reverses an order of applying the video signal to the plurality of video signal lines every the predetermined period, wherein the common electrode is commonly provided for the plurality of pixel electrodes so as to form predetermined capacitances with the plurality of pixel electrodes, the common electrode being alternately switched between a high potential voltage level and a low potential voltage level every the predetermined period, wherein the video signal line drive circuit includes a shift register for shifting timing data that is externally inputted in order to generate a plurality of sampling pulses used for sequentially applying the video signal to the plurality of video signal lines, wherein the shift register shifts the timing data in a reverse direction every the predetermined period, and wherein the video signal is sequentially applied to the video signal lines in accordance with the plurality of sampling pulses generated in accordance with a direction in which to shift the timing data.

2. The drive circuit according to claim 1, wherein the video signal line drive circuit is composed of a first video signal line drive circuit and a second video signal line drive circuit, wherein the first video signal line drive circuit and the second video signal line drive circuit are alternately used every the predetermined period so as to sequentially apply the video signal to the video signal lines, and wherein an order in which the first video signal line drive circuit applies the video signal to the video signal lines is opposite to an order in which the second video signal line drive circuit applies the video signal to the video signal lines.

3. A display device comprising a plurality of video signal lines for transmitting an externally inputted video signal representing an image to be displayed, a plurality of scanning signal lines crossing the plurality of video signal lines, a plurality of switching elements arranged in a matrix form at their corresponding intersections between the plurality of video signal lines and the plurality of scanning signal lines, a plurality of pixel electrodes connected to their respective switching elements, and a display section for displaying the image, including the plurality of video signal lines, the plurality of scanning signal lines, the plurality of switching elements, the plurality of pixel electrodes, and a common electrode, the display device comprising:

a scanning signal line drive circuit for selectively driving each of the plurality of scanning signal lines for a predetermined period; and a video signal line drive circuit for sequentially applying a voltage to the plurality of video signal lines as the video signal, while reversing a polarity of the video signal every the predetermined period, wherein the video signal line drive circuit reverses an order of applying the video signal to the plurality of video signal lines every the predetermined period, wherein the common electrode is commonly provided for the plurality of pixel electrodes so as to form predetermined capacitances with the plurality of pixel electrodes, the common electrode being alternately switched between a high potential voltage level and a low potential voltage level every predetermined period, wherein the video signal line drive circuit includes a shift register for shifting timing data that is externally inputted in order to generate a plurality of sampling pulses used for sequentially applying the video signal to the plurality of video signal lines, wherein the shift register shifts the timing data in a reverse direction every the predetermined period, and wherein the video signal is sequentially applied to the video signal lines in accordance with the plurality of sampling pulses generated in accordance with a direction in which to shift the timing data.

4. The display device according to claim 3, wherein the video signal line drive circuit is composed of a first video signal line drive circuit and a second video signal line drive circuit, wherein the first video signal line drive circuit and the second video signal line drive circuit are alternately used every the predetermined period so as to sequentially apply the video signal to the video signal lines, and wherein an order in which the first video signal line drive circuit applies the video signal to the video signal lines is opposite to an order in which the second video signal line drive circuit applies the video signal to the video signal lines.

5. The display device according to claim 3, further comprising an image data-order reversal portion for reversing a top-to-bottom order of the image data corresponding to the predetermined period every the predetermined period, wherein the video signal line drive circuit sequentially applies the video signal to the plurality of video signal lines in accordance with the image data having its top-to-bottom order reversed by the image data-order reversal portion every the predetermined period.

6. The display device according to claim 5, wherein the image data-order reversal portion includes a memory for storing the image data corresponding to at least the predetermined period.

7. The display device according to claim 3, wherein liquid crystal is used as a display medium.

8. The display device according to claim 7, wherein the display section, the video signal line drive circuit, and the scanning signal line drive circuit are provided on the same board.

9. The display device according to claim 3, wherein drain terminals of the plurality of switching elements and the plurality of video signal lines are short-circuited to allow correction of pixel defects.

10. A drive method for a display device including a plurality of video signal lines for transmitting an externally inputted video signal representing an image to be displayed, a plurality of scanning signal lines crossing the plurality of video signal lines, a plurality of switching elements arranged in a matrix form at their corresponding intersections between the plurality of video signal lines and the plurality of scanning signal lines, a plurality of pixel electrodes connected to their respective switching elements, and a display section for displaying the image, including the plurality of video signal lines, the plurality of scanning signal lines, the plurality of switching elements, the plurality of pixel electrodes, and a common electrode, the method comprising:

a scanning signal line drive step for selectively driving each of the plurality of scanning signal lines for a predetermined period; and a video signal line drive step for sequentially applying a voltage to the plurality of video signal lines as the video signal, while reversing a polarity of the video signal every the predetermined period, wherein in the video signal line drive step, an order of applying the video signal to the plurality of video signal lines is reversed every the predetermined period, wherein the common electrode is commonly provided for the plurality of pixel electrodes so as to form predetermined capacitances with the plurality of pixel electrodes, the common electrode being alternately switched between a high potential voltage level and a low potential voltage level every predetermined period, wherein the video signal line drive step includes using a shift register to shift timing data that is externally inputted in order to generate a plurality of sampling pulses used for sequentially applying the video signal to the plurality of video signal lines, wherein the shift register shifts the timing data in a reverse direction every the predetermined period, and wherein the video signal is sequentially applied to the video signal lines in accordance with the plurality of sampling pulses generated in accordance with a direction in which to shift the timing data.

11. The drive method according to claim 10, further comprising an image data-order reversal step for reversing a top-to-bottom order of the image data corresponding to the predetermined period every the predetermined period, wherein in the video signal line drive step, the video signal is sequentially applied to the plurality of video signal lines in accordance with the image data having its top-to-bottom order reversed by the image data-order reversal step every the predetermined period.

* * * * *